US008669224B2

(12) United States Patent
Miralles et al.

(10) Patent No.: US 8,669,224 B2
(45) Date of Patent: Mar. 11, 2014

(54) USE OF HYDROXYCARBOXYLATES FOR WATER HARDNESS CONTROL

(75) Inventors: Altony J. Miralles, Woodbury, MN (US); Carter M. Silvernail, St. Louis Park, MN (US)

(73) Assignee: Ecolab USA Inc, St. Paul, MN (US)

( * ) Notice: Subject to any disclaimer, the term of this patent is extended or adjusted under 35 U.S.C. 154(b) by 655 days.

(21) Appl. No.: 12/560,848

(22) Filed: Sep. 16, 2009

(65) Prior Publication Data

US 2010/0229897 A1 Sep. 16, 2010

Related U.S. Application Data

(60) Provisional application No. 61/097,398, filed on Sep. 16, 2008.

(51) Int. Cl.

| | |
|---|---|
| ***C11D 3/20*** | (2006.01) |
| ***C11D 3/04*** | (2006.01) |
| *C11D 7/06* | (2006.01) |
| *C11D 7/26* | (2006.01) |

(52) U.S. Cl.

CPC ..... *C11D 3/044* (2013.01); *C11D 3/2086* (2013.01); *C11D 7/06* (2013.01); *C11D 7/265* (2013.01)

USPC ..... 510/488

(58) Field of Classification Search

CPC ..... C11D 3/044; C11D 3/2086; C11D 7/06; C11D 7/265

USPC ..... 510/488

See application file for complete search history.

(56) References Cited

U.S. PATENT DOCUMENTS

| | | | | |
|---|---|---|---|---|
| 3,692,685 | A | | 9/1972 | Lamberti et al. |
| 3,865,755 | A | | 2/1975 | Lannert |
| 3,948,985 | A | | 4/1976 | Blumbergs et al. |
| 3,993,575 | A | * | 11/1976 | Howanitz et al. ..... 510/434 |
| 4,014,929 | A | | 3/1977 | Stahlheber |
| 4,049,467 | A | * | 9/1977 | Rubin ..... 134/2 |
| 4,115,293 | A | * | 9/1978 | Schoenholz et al. ..... 510/117 |
| 4,124,522 | A | * | 11/1978 | Barton ..... 134/42 |
| 4,663,071 | A | | 5/1987 | Bush et al. |
| 4,867,901 | A | | 9/1989 | Bosch et al. |
| 4,904,824 | A | | 2/1990 | Horng et al. |
| 5,015,466 | A | | 5/1991 | Parran, Jr. et al. |
| 5,015,467 | A | | 5/1991 | Smitherman |

(Continued)

FOREIGN PATENT DOCUMENTS

| | | |
|---|---|---|
| EP | 0463802 B1 | 9/1998 |
| WO | WO97/19158 | 5/1997 |

OTHER PUBLICATIONS

Simultaneous Determination of Ascorbic, Citric, and Tartaric Acids by Potentionmetric Titration with PLS Calibration, Akhond et al., Pleiades Publishing, 2006, pp. 804-808.*

(Continued)

*Primary Examiner* — Gregory Webb

(74) *Attorney, Agent, or Firm* — Amy J. Hoffman; Andrew D. Sorensen

(57) ABSTRACT

The present invention relates to compositions including threshold agents, and methods of use thereof. The threshold agents can include hydroxycarboxylate compounds present at an amount sufficient to control water hardness. The threshold agents are present in the wash solution at a molar amount less than the molar amount of water hardness ions present.

8 Claims, 8 Drawing Sheets

(56) References Cited

U.S. PATENT DOCUMENTS

| | | | | | |
|---|---|---|---|---|---|
| 5,028,723 | A | | 7/1991 | Horng | |
| 5,030,751 | A | | 7/1991 | Lamberti et al. | |
| 5,068,420 | A | | 11/1991 | Kreczmer | |
| 5,256,327 | A | | 10/1993 | Allen et al. | |
| 5,268,283 | A | | 12/1993 | Mothes et al. | |
| 5,279,756 | A | | 1/1994 | Savio et al. | |
| 5,356,803 | A | * | 10/1994 | Carpenter et al. | 435/200 |
| 5,391,696 | A | | 2/1995 | Krone et al. | |
| 5,466,875 | A | | 11/1995 | Gutierrez et al. | |
| 5,492,629 | A | * | 2/1996 | Ludwig et al. | 210/698 |
| 5,658,867 | A | | 8/1997 | Pancheri et al. | |
| 5,726,139 | A | * | 3/1998 | Willey et al. | 510/181 |
| 5,786,314 | A | | 7/1998 | Sadlowski | |
| 5,786,315 | A | | 7/1998 | Sadlowski | |
| 5,830,536 | A | * | 11/1998 | Garduno | 427/387 |
| 6,096,696 | A | * | 8/2000 | Tsao et al. | 510/112 |
| 6,171,404 | B1 | * | 1/2001 | Bhatia et al. | 134/3 |
| 6,596,682 | B1 | | 7/2003 | Gorlin et al. | |
| 6,673,766 | B1 | | 1/2004 | Hartshorn et al. | |
| 6,861,401 | B2 | | 3/2005 | Gordon | |
| 7,642,227 | B2 | * | 1/2010 | Kurtz | 510/424 |
| 2001/0014655 | A1 | | 8/2001 | Moster et al. | |
| 2005/0239681 | A1 | | 10/2005 | Speckmann et al. | |
| 2008/0032908 | A1 | * | 2/2008 | Kurtz | 510/218 |

OTHER PUBLICATIONS

Heinzman, Stephan, "Small-Molecule Polycarboxylate Builders", Procter & Gamble, Journal of Surfactants and Detergents, vol. 1, No. 1 (Jan. 1998), pp. 105-108.

* cited by examiner

USE OF HYDROXYCARBOXYLATES FOR WATER HARDNESS CONTROL

CROSS REFERENCE TO RELATED APPLICATIONS

This application claims priority to U.S. Provisional Application Ser. No. 61/097,398, filed on Sep. 16, 2008 and entitled "USE OF HYDROXYCARBOXYLATES FOR WATER HARDNESS CONTROL." The entire contents of this patent application are hereby expressly incorporated herein by reference including, without limitation, the specification, claims, and abstract, as well as any figures, tables, or drawings thereof.

FIELD OF THE INVENTION

The present invention is related to compositions including a threshold agent, i.e., a hydroxycarboxylate, and methods of employing them. The methods and compositions provide a threshold agent at an amount sufficient to control water hardness, i.e., to substantially reduce or inhibit calcium precipitation, in the wash solutions in which they are present. The compositions can be used for cleaning and rinsing articles with reduced hard water spotting and scaling.

BACKGROUND

The level of hardness in water can have a deleterious effect in many systems. For example, when hard water alone, or in conjunction with cleaning compositions, contacts a surface, it can cause precipitation of hard water scale on the contacted surface. In general, hard water refers to water having a total level of calcium and magnesium ions in excess of about 100 ppm expressed in units of ppm calcium carbonate. Often, the molar ratio of calcium to magnesium in hard water is about 2:1 or about 3:1. Although most locations have hard water, water hardness tends to vary from one location to another.

Hard water is also known to reduce the efficacy of detergents. One method for counteracting this includes adding chelating agents or sequestrants into detersive compositions that are intended to be mixed with hard water in an amount sufficient to handle the hardness. However, in many instances the water hardness exceeds the chelating capacity of the composition. As a result, free calcium ions may be available to attack active components of the composition, to cause precipitation, or to cause other deleterious effects, such as poor cleaning effectiveness or lime scale build up.

SUMMARY

In some aspects, the present invention provides a method for cleaning an article. The method comprises providing a cleaning composition. The cleaning composition may comprise, consist essentially of, or consist of: (i) a hydroxycarboxylate compound, and/or a salt thereof; and (ii) a source of alkalinity. The cleaning composition is diluted with water to form a wash solution such that the hydroxycarboxylate compound is present in the wash solution at about 10 ppm to about 100 ppm. The article is then contacted with the wash solution, such that the article is cleaned.

In other aspects the present invention provides a cleaning composition comprising, consisting essentially of, or consisting of: (a) about 0.004 wt-% to about 0.008 wt-% of a hydroxycarboxylate; and (b) about 0 wt % to about 50 wt-% source of alkalinity.

In yet other aspects, the present invention provides methods for removing soil from a motor vehicle. The method may comprise, consist of, or consist essentially of providing a cleaning composition. The cleaning composition may comprise, consist of, or consist essentially of: (i) a hydroxycarboxylate compound, or salt thereof; and (ii) a source of alkalinity. The method also includes diluting the cleaning composition with water to form a wash solution such that the hydroxycarboxylate compound is present in the wash solution at about 10 ppm to about 100 ppm. The motor vehicle is then contacted with the wash solution such that the motor vehicle is cleaned.

DETAILED DESCRIPTION

Figure 1:
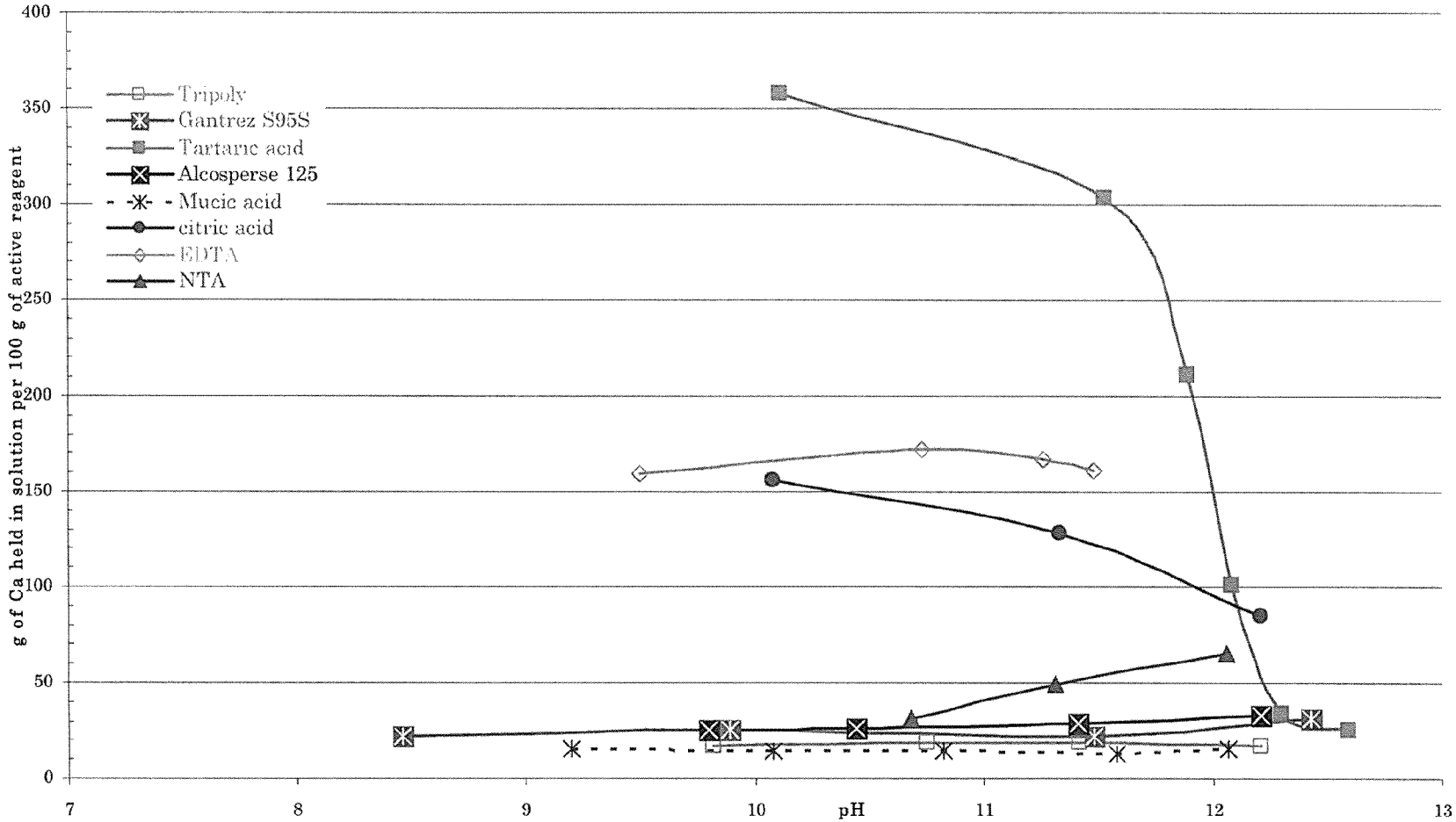
FIG. 1 is a graphical depiction of the grams of calcium held in solution per 100 g of test solution used as described in Example 2.

In some aspects, the present invention provides compositions and methods for cleaning an article. In some embodiments, a cleaning composition including a threshold agent, i.e., a hydroxycarboxylate compound, or salt thereof, and a source of alkalinity is provided. The composition is diluted with water to form a wash solution. In some embodiments, the composition is diluted such that the threshold agent, i.e., hydroxycarboxylate compound, is present in the wash solution at about 10 ppm to about 100 ppm. The article to be cleaned is then contacted with the wash solution, such that the article is cleaned.

So that the present invention may be more readily understood certain terms are first defined.

As used herein, the terms "chelating agent" and "sequestrant" refer to a compound that forms a complex (soluble or not) with water hardness ions (from the wash water, soil and substrates being washed) in a specific molar ratio. Chelating agents that can form a water soluble complex include trisodium phosphate, EDTA, DTPA, NTA, citrate, and the like. Sequestrants that can form an insoluble complex include sodium triphosphate, zeolite A, and the like. As used herein, the terms "chelating agent" and "sequestrant" are synonymous.

As used herein, the term "free of chelating agent" or "substantially free of chelating agent" refers to a composition, mixture, or ingredients that does not contain a chelating agent or sequestrant or to which only a limited amount of a chelating agent or sequestrant has been added. Should a chelating agent or sequestrant be present, the amount of a chelating agent or sequestrant shall be less than about 7 wt-%. In some embodiments, such an amount of a chelating agent or sequestrant is less than about 2 wt-%. In other embodiments, such an amount of a chelating agent or sequestrant is less then about 0.5 wt-%. In still yet other embodiments, such an amount of a chelating agent or sequestrant is less than about 0.1 wt-%.

As used herein, the term "lacking an effective amount of chelating agent" refers to a composition, mixture, or ingredients that contains too little chelating agent or sequestrant to measurably affect the hardness of water.

As used herein, the terms "threshold agent," "crystal modifier," or "crystal growth modifier" refer to a compound that substantially reduces or inhibits crystallization of water hardness ions from solution, but that need not form a specific complex with the water hardness ion. Unlike chelating agents, threshold agents or crystal modifiers modify the kinetics of scale forming processes when used at sub-stoichiometric concentrations. This distinguishes a threshold agent from a chelating agent or sequestrant. Without wishing to be bound by any particular theory, it is thought that threshold agents work either by modifying crystal growth or by reducing the rate of nucleation (kinetic effects).

As used herein, the term "phosphate-free" or "substantially phosphate-free" refers to a composition, mixture, or ingredient that does not contain a phosphate or phosphate-containing compound or to which a phosphate or phosphate-containing compound has not been added. Should a phosphate or phosphate-containing compound be present through contamination of a phosphate-free composition, mixture, or ingredients, the amount of phosphate shall be less than about 1.0 wt-%. In some embodiments, the amount of phosphate is less than about 0.5 wt-%. In other embodiments, the amount of phosphate is less then about 0.1 wt-%. In still yet other embodiments, the amount of phosphate is less than about 0.01 wt-%.

As used herein, the term "phosphorus-free" or "substantially phosphorus-free" refers to a composition, mixture, or ingredient that does not contain phosphorus or a phosphorus-containing compound or to which phosphorus or a phosphorus-containing compound has not been added. Should phosphorus or a phosphorus-containing compound be present through contamination of a phosphorus-free composition, mixture, or ingredients, the amount of phosphorus shall be less than about 1.0 wt-%. In some embodiments, the amount of phosphorous is less than about 0.5 wt-%. In other embodiments, the amount of phosphorus is less than about 0.1 wt-%. In still yet other embodiments, the amount of phosphorus is less than about 0.01 wt %.

By the term "solid" as used to describe a composition of the present invention, it is meant that the hardened composition will not flow perceptibly and will substantially retain its shape under moderate stress or pressure or mere gravity, as for example, the shape of a mold when removed from the mold, the shape of an article as formed upon extrusion from an extruder, and the like. The degree of hardness of the solid composition can range from that of a fused solid block which is relatively dense and hard, for example, like concrete, to a consistency characterized as being malleable and sponge-like, similar to caulking material.

"Cleaning" means to perform or aid in soil removal, bleaching, microbial population reduction, or combination thereof.

As used herein, the term "ware" refers to items such as eating and cooking utensils and other hard surfaces such as showers, sinks, toilets, bathtubs, countertops, windows, mirrors, and floors. As used herein, the term "warewashing" refers to washing, cleaning, or rinsing ware.

As used herein, the term "hard surface" includes, but is not limited to, showers, sinks, toilets, bathtubs, countertops, windows, mirrors, transportation vehicles, floors, and the like. Examples of transportation vehicles include, but are not limited to, cars, trucks, vans, and motorcycles.

As used herein, the phrase "health care surface" refers to a surface of an instrument, a device, a cart, a cage, furniture, a structure, a building, or the like that is employed as part of a health care activity. Examples of health care surfaces include, but are not limited to, surfaces of medical or dental instruments, of medical or dental devices, of autoclaves and sterilizers, of electronic apparatus employed for monitoring patient health, and of floors, walls, or fixtures of structures in which health care occurs. Health care surfaces are found in hospital, surgical, infirmity, birthing, mortuary, and clinical diagnosis rooms. These surfaces can be those typified as "hard surfaces" (such as walls, floors, bed-pans, etc.,), or fabric surfaces, e.g., knit, woven, and non-woven surfaces (such as surgical garments, draperies, bed linens, bandages, etc.,), or patient-care equipment (such as respirators, diagnostic equipment, shunts, body scopes, wheel chairs, beds, etc.,), or surgical and diagnostic equipment. Health care surfaces include articles and surfaces employed in animal health care.

As used herein the term "laundry" refers to any article, textile or fabric material that is laundered. Representative textiles which can be treated by the compositions and methods of the present invention include, but are not limited to, those derived from natural and synthetic fibers including celluloses, acrylics, olefins, acetates, aramids, nylons, polyesters, segmented polyurethanes (spandex), regenerated proteins (azlon), polyphenylene sulfides, and carbon/graphite fibers as well as inorganic fibers based on glass, metal, or ceramic constituents. These representative textiles may be incorporated into a variety of articles including, for example, clothing, uniforms, coverings, window treatments and carpeting As used herein, the term "instrument" refers to the various medical or dental instruments or devices that can benefit from cleaning using water treated according to the methods of the present invention.

As used herein, the phrases "medical instrument," "dental instrument," "medical device," "dental device," "medical equipment," or "dental equipment" refer to instruments, devices, tools, appliances, apparatus, and equipment used in medicine or dentistry. Such instruments, devices, and equipment can be cold sterilized, soaked or washed and then heat sterilized, or otherwise benefit from cleaning using water treated according to the present invention. These various instruments, devices and equipment include, but are not limited to: diagnostic instruments, trays, pans, holders, racks, forceps, scissors, shears, saws (e.g. bone saws and their blades), hemostats, knives, chisels, rongeurs, files, nippers, drills, drill bits, rasps, burrs, spreaders, breakers, elevators, clamps, needle holders, carriers, clips, hooks, gouges, curettes, retractors, straightener, punches, extractors, scoops, keratomes, spatulas, expressors, trocars, dilators, cages, glassware, tubing, catheters, cannulas, plugs, stents, scopes (e.g., endoscopes, stethoscopes, and arthroscopes) and related equipment, and the like, or combinations thereof.

As used herein, "weight percent (wt-%)," "percent by weight," "% by weight," and the like are synonyms that refer to the concentration of a substance as the weight of that substance divided by the total weight of the composition and multiplied by 100.

As used herein, the term "about" modifying the quantity of an ingredient in the compositions of the invention or employed in the methods of the invention refers to variation in the numerical quantity that can occur, for example, through typical measuring and liquid handling procedures used for making concentrates or use solutions in the real world; through inadvertent error in these procedures; through differences in the manufacture, source, or purity of the ingredients employed to make the compositions or carry out the methods; and the like. The term about also encompasses amounts that differ due to different equilibrium conditions for a composition resulting from a particular initial mixture. Whether or not modified by the term "about," the claims include equivalents to the quantities.

Cleaning Compositions

In some aspects, the present invention is directed to cleaning compositions. In some embodiments, the cleaning compositions include: a threshold agent, i.e., a hydroxycarboxylate compound or compounds; and a source of alkalinity. The cleaning compositions can be substantially free of a compound selected from the group consisting of phosphates, polyphosphates, phosphonates, aminocarboxylates, and mixtures thereof. In some embodiments, the cleaning compositions include less than 1 wt-% phosphorus. In other embodiments, the compositions include less than 1 wt-% phosphate.

Threshold Agents

In some embodiments, the compositions of the present invention include a threshold agent or agents. Exemplary threshold agents for use with the methods and compositions of the present invention include, but are not limited to, hydroxycarboxylate compounds. As used herein the term "hydroxycarboxylate" or "hydroxycarboxylic acid" refers to compounds including a carboxyl group, which has the formula C(=O)OH, as well as a hydroxy group, i.e., an —OH group, and salts, esters, or anhydrides thereof. Hydroxycarboxylates include, but are not limited to, compounds with one, two, or three carboxyl groups. Hydroxycarboxylates for use in the compositions and methods of the present invention include, for example, tartaric acid, glycolic acid, lactic acid, glyceric acid, citric acid, and salts, esters, or anhydrides thereof. In some embodiments, the hydroxycarboxylate compound is tartaric acid, and salts, esters, and anhydrides thereof.

Hydroxycarboxylate salts suitable for use in the compositions and methods of the present invention include, but are not limited to, sodium salts (e.g., mono- and di-sodium salts), potassium salts (e.g., mono- and di-potassium salts), calcium salts, lithium salts, amine salts and combinations thereof. In some embodiments, the composition of the present invention includes a salt of a hydroxycarboxylate compound. In some embodiments, the hydroxycarboxylate compound salt includes a tartaric acid salt of the formula $+NR_1R_2R_3R_4$ wherein $R_1$, $R_2$, $R_3$, and $R_4$ are each individually hydrogen, $C_{1-20}$ alkyl, $C_{1-20}$ substituted alkyl and combinations thereof.

Without wishing to be bound by any particular theory, it is thought that the hydroxycarboxylate compound present in the cleaning composition acts as a crystal modifier or threshold agent. That is, it is thought that the hydroxycarboxylate compound substantially inhibits or reduces the crystallization of water hardness ions from solution. It has been found that the hydroxycarboxylate reduces or inhibits the precipitation of water hardness ions out of solution at much lower levels of hydroxycarboxylate than those needed when using a conventional chelating agent or sequestrant.

For example, in some embodiments, a cleaning composition of the present invention including a hydroxycarboxylate compound is diluted such that the molar amount of hydroxycarboxylate compound present in the wash solution is less than the molar amount of hardness ions in the water of the wash solution. In some embodiments, a cleaning composition of the present invention including a hydroxycarboxylate compound is diluted such that the hydroxycarboxylate compound is present in the diluted solution at about 10 to about 100 ppm, about 20 ppm to about 100 ppm, or about 40 ppm to about 80 ppm. In still yet other embodiments, a cleaning composition of the present invention including a hydroxycarboxylate compound is diluted such that the hydroxycarboxylate compound is present in the diluted solution at about 50 ppm to about 70 ppm. It is to be understood that all ranges and values between these ranges and values are encompassed by the present invention.

Alkalinity Source

In some aspects, the compositions of the present invention further include one or more alkalinity sources. The alkaline source can be selected such that it enhances the cleaning of an article, and improves the soil removal performance of the composition. In general, an effective amount of one or more alkaline sources should be considered as an amount that provides a use composition having a pH of at least about 8. When the use composition has a pH of between about 8 and about 10, it can be considered mildly alkaline, and when the pH is greater than about 12, the use composition can be considered caustic. In general, it is desirable to provide the use composition as a mildly alkaline cleaning composition because it is considered to be safer than the caustic based use compositions.

The cleaning composition can include an alkali metal carbonate and/or an alkali metal hydroxide as a suitable alkaline source. Suitable metal carbonates that can be used include, for example, sodium carbonate, potassium carbonate, lithium carbonate, sodium bicarbonate, potassium bicarbonate, lithium bicarbonate, sodium sesquicarbonate, potassium sesquicarbonate, lithium sesquicarbonate, and combinations thereof. Suitable alkali metal hydroxides that can be used include, for example, sodium hydroxide, lithium hydroxide, potassium hydroxide, and combinations thereof. An alkali metal hydroxide can be added to the composition in the form of solid beads, dissolved in an aqueous solution, or a combination thereof. Alkali metal hydroxides are commercially available as a solid in the form of prilled solids or beads having a mix of particle sizes ranging from about 12-100 U.S. mesh, or as an aqueous solution, as for example, as a 50 wt-% and a 73 wt-% solution.

In some embodiments, the compositions of the present invention include an alkaline source in an amount of about 0.01 wt-% to about 1.0 wt-%, about 5 wt-% to about 10 wt-%, or at least about 15 wt-%. The cleaning compositions can include about 10 to about 95 wt-%, about 20 to about 75 wt-%, or about 25 to about 65 wt-% of a source of alkalinity. It is to be understood that all ranges and values between these ranges and values are encompassed by the present invention In some embodiments, the alkaline source can be provided in an amount of less than about 60 wt-%. In addition, the alkaline source can be provided at a level of less than about 40 wt-%, less than about 30 wt-%, or less than about 20 wt-%. In certain embodiments, it is expected that the solid cleaning composition can provide a use composition that is useful at pH levels below about 8. In such compositions, an alkaline source can be omitted, and additional pH adjusting agents can be used to provide the use composition with the desired pH. Accordingly, it should be understood that the source of alkalinity can be characterized as an optional component.

In some embodiments, the alkalinity source is selected from the group consisting of an alkali metal carbonate, an alkali metal hydroxide, and combinations thereof. In other embodiments, the alkali metal carbonate is selected from the group consisting of sodium carbonate, potassium carbonate, lithium carbonate, sodium bicarbonate, potassium bicarbonate, lithium bicarbonate, sodium sesquicarbonate, potassium sesquicarbonate, lithium sesquicarbonate, and combinations thereof. In still yet other embodiments, the alkali metal hydroxide is selected from the group consisting of sodium hydroxide, lithium hydroxide, potassium hydroxide, and combinations thereof.

Secondary Alkalinity Sources

Compositions of the present invention can also include a secondary alkaline source separate from the source of alkalinity discussed above. The secondary source of alkaline can include about 0 to about 75 wt-%, about 0.1 to about 70 wt-%, about 1 to about 25 wt-%, about 5 to about 10 wt-%, about 20 to about 60 wt-%, or about 30 to about 70 wt-% of the total composition.

Secondary alkalinity sources can include, for example, inorganic alkalinity sources, such as an alkali metal hydroxide or silicate, or the like. Suitable alkali metal hydroxides include, for example, sodium, potassium, or lithium hydroxide. An alkali metal hydroxide may be added to the composition in a variety of forms, including for example in the form of solid beads, dissolved in an aqueous solution, or a combination thereof. Examples of useful alkaline metal silicates include sodium, potassium, or lithium silicate (with a $M_2O$:$SiO_2$ ratio of 1:1.8 to 5:1, M representing an alkali metal) or metasilicate.

Other sources of alkalinity include: a metal borate such as sodium or potassium borate; ethanolamines and amines; and other like alkaline sources.

Additional Ingredients

In some embodiments, the compositions of the present invention further include an additional ingredient. Additional ingredients suitable for use with the compositions of the present invention include, but are not limited to, surfactants, builders, water, pH modifiers, processing aids, detersive polymers, rinse aid compositions, softeners, source of acidity, anti-corrosion agent, filler, defoamer, anti-redeposition agent, antimicrobial, aesthetic enhancing agent, e.g., dye, odorant, perfume, optical brightener, lubricant composition, bleaching agent, enzyme, effervescent agent, activator for the source of alkalinity, calcium salt, and/or other such additives or functional ingredients. In some embodiments, the compositions of the present invention do not include a surfactant.

The additional ingredient or ingredients will vary according to the type of composition being manufactured, and the intended end use of the composition. In some embodiments, the composition includes as an additive one or more of surfactant, cleaning enzyme, detersive polymer, antimicrobial, activators for the source of alkalinity, or mixtures thereof.

Organic Surfactants or Cleaning Agents

In some embodiments, the cleaning compositions of the present invention can include at least one cleaning agent which can be a surfactant or surfactant system. A variety of surfactants can be used in the cleaning composition, including anionic, nonionic, cationic, and zwitterionic surfactants, which are commercially available from a number of sources. In some embodiments, the surfactant is selected from the group consisting of nonionic surfactants, cationic surfactants, anionic surfactants, amphoteric surfactants, or combinations thereof.

Suitable surfactants include nonionic surfactants. Suitable nonionic surfactants include low foaming non-ionic surfactants. For a discussion of surfactants, see Kirk-Othmer, *Encyclopedia of Chemical Technology*, Third Edition, volume 8, pages 900-912.

Nonionic surfactants useful in the present solid compositions include those having a polyalkylene oxide polymer as a portion of the surfactant molecule. Such nonionic surfactants include, for example, chlorine-, benzyl-, methyl-, ethyl-, propyl-, butyl- and other like alkyl-capped polyethylene and/or polypropylene glycol ethers of fatty alcohols; polyalkylene oxide free nonionics such as alkyl polyglycosides; sorbitan and sucrose esters and their ethoxylates; alkoxylated ethylene diamine; carboxylic acid esters such as glycerol esters, polyoxyethylene esters, ethoxylated and glycol esters of fatty acids, and the like; carboxylic amides such as diethanolamine condensates, monoalkanolamine condensates, polyoxyethylene fatty acid amides, and the like; and ethoxylated amines and ether amines commercially available from Tomah Corporation and other like nonionic compounds. Silicone surfactants such as the ABIL B8852 (Goldschmidt) can also be used.

Additional suitable nonionic surfactants having a polyalkylene oxide polymer portion include nonionic surfactants of C6-C24 alcohol ethoxylates (e.g., C9-C11, C12-C16 alcohol ethoxylates) having 1 to about 20 ethylene oxide groups (e.g., about 6 to about 20 ethylene oxide groups); C6-C24 alkylphenol ethoxylates (e.g., C8-C10 alkylphenol ethoxylates) having 1 to about 100 ethylene oxide groups (e.g., about 12 to about 20 ethylene oxide groups); C6-C24 alkylpolyglycosides (e.g., C6-C20 alkylpolyglycosides) having 1 to about 20 glycoside groups (e.g., about 9 to about 20 glycoside groups); C6-C24 fatty acid ester ethoxylates, propoxylates or glycerides; and C4-C24 mono or dialkanolamides.

Specific alcohol alkoxylates include alcohol ethoxylate propoxylates, alcohol propoxylates, alcohol propoxylate ethoxylate propoxylates, alcohol ethoxylate butoxylates, and the like; nonylphenol ethoxylate, polyoxyethylene glycol ethers and the like; and polyalkylene oxide block copolymers including an ethylene oxide/propylene oxide block copolymer such as those commercially available under the trademark PLURONIC (BASF-Wyandotte), and the like.

Suitable nonionic surfactants include low foaming nonionic surfactants. Examples of suitable low foaming nonionic surfactants include secondary ethoxylates, such as those sold under the trade name TERGITOL™, such as TERGITOL™ 15-S-7 (Union Carbide), Tergitol 15-S-3, Tergitol 15-S-9 and the like. Other suitable classes of low foaming nonionic surfactant include alkyl or benzyl-capped polyoxyalkylene derivatives and polyoxyethylene/polyoxypropylene copolymers.

A useful nonionic surfactant for use as a defoamer is nonylphenol having an average of 12 moles of ethylene oxide condensed thereon, it being end capped with a hydrophobic portion including an average of 30 moles of propylene oxide. Silicon-containing defoamers are also well-known and can be employed in the compositions and methods of the present invention.

Suitable amphoteric surfactants include amine oxide compounds having the formula:

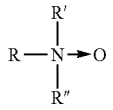

where R, R', R", and R"' are each a $C_1$-$C_{24}$ alkyl, aryl or aralkyl group that can optionally contain one or more P, O, S or N heteroatoms.

Another class of suitable amphoteric surfactants includes betaine compounds having the formula:

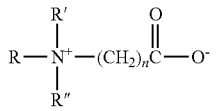

where R, R', R" and R"' are each a $C_1$-$C_{24}$ alkyl, aryl or aralkyl group that can optionally contain one or more P, O, S or N heteroatoms, and n is about 1 to about 10.

Suitable surfactants include food grade surfactants, linear alkylbenzene sulfonic acids and their salts, and ethylene oxide/propylene oxide derivatives sold under the Pluronic™ trade name. Suitable surfactants include those that are compatible as an indirect or direct food additive or substance; especially those described in the Code of Federal Regulations (CFR), Title 21—Food and Drugs, parts 170 to 186 (which is incorporated herein by reference).

Anionic surfactants suitable for the present cleaning compositions, include, for example, carboxylates such as alkylcarboxylates (carboxylic acid salts) and polyalkoxycarboxylates, alcohol ethoxylate carboxylates, nonylphenol ethoxylate carboxylates, and the like; sulfonates such as alkylsulfonates, alkylbenzenesulfonates, alkylarylsulfonates, sulfonated fatty acid esters, and the like; sulfates such as sulfated alcohols, sulfated alcohol ethoxylates, sulfated alkylphenols, alkylsulfates, sulfosuccinates, alkylether sulfates, and the like; and phosphate esters such as alkylphosphate esters, and the like. Suitable anionics include sodium alkylarylsulfonate, alpha-olefin sulfonate, and fatty alcohol sulfates. Examples of suitable anionic surfactants include sodium dodecylbenzene sulfonic acid, potassium laureth-7 sulfate, and sodium tetradecenyl sulfonate.

The surfactant can be present at amounts of about 0 to about 20 wt-% about 0.1 to about 10 wt-%, about 0.2 to about 5 wt-%.

Builder

In some embodiments, the compositions of the present invention include about 0 to about 10 wt-%, about 2 to about 8 wt-%, or about 5 wt-% of a builder, e.g., a chelating or sequestering agent. In other embodiments, the compositions of the present invention are substantially free of a builder, e.g., a chelating, or sequestering agent. Chelating agents or sequestrants include, but are not limited to, phosphonates, phosphates, aminocarboxylates, and polycarboxylates.

Both organic and inorganic chelating agents are common. Inorganic chelating agents include such compounds as sodium pyrophosphate, and sodium tripolyphosphate. Organic chelating agents include both polymeric and small molecule chelating agents. Polymeric chelating agents commonly include ionomer compositions such as polyacrylic acids compounds. Small molecule organic chelating agents include amino-carboxylates such as salts of ethylenediaminetetracetic acid (EDTA) and hydroxyethylenediaminetetracetic acid, nitrilotriacetic acid, ethylenediaminetetrapropionates, triethylenetetraminehexacetates, and the respective alkali metal ammonium and substituted ammonium salts thereof. Phosphonates are also suitable for use as chelating agents in the composition of the invention and include ethylenediamine tetra(methylenephosphonate), nitrilotrismethylenephosphonate, diethylenetriaminepenta(methylene phosphonate), hydroxyethylidene diphosphonate, and 2-phosphonobutane-1,2,4-tricarboxylic acid. Preferred chelating agents include the phosphonates amino-carboxylates. These phosphonates commonly contain alkyl or alkylene groups with less than 8 carbon atoms.

In some embodiments, the compositions of the present invention lack an effective amount of a builder. An ineffective amount of builder will vary with the hardness of the water and the dilution rate of a concentrate. For example, for 17 grain hard water, an ineffective amount of a chelating agent or sequestrant in a use composition can be less than about 15 wt-%. This is based on a composition used at a 1000 ppm concentration and STPP as a chelating agent/sequestrant. Thus 15 wt-% STPP would chelate about 25% of the hardness ions present. In some embodiments, an ineffective amount is less than about 15 wt-%, less than about 5 wt-% or less than about 1 wt-%. The effective level of a chelating agent or sequestrant will be dependent upon the chemical structure of the compound and the dilution rate of the formulation containing it.

Water

In some embodiments, the cleaning compositions of the present invention can include water. Water can be independently added to the composition or can be provided in the composition as a result of its presence in an aqueous material that is added to the composition. Typically, water is introduced into the composition to provide the composition with a desired flowability prior to solidification and to provide a desired rate of solidification. Water can be added to form cleaning composition physical forms such as a solid, a slurry, a gel, and/or a paste.

In some embodiments, the composition includes about 1 to about 50 wt-% water, about 10 to about 40 wt-% water, or about 20 to about 30 wt-% water. In some embodiments, the cleaning compositions include less than about 1 wt-% water. In some embodiments, the compositions of the present invention include at least about 15 wt-% water. It is to be understood that all values and ranges between these values and ranges are encompassed by the present invention.

pH Modifier

In some embodiments, the compositions of the present invention further include a pH modifier. The pH modifier can be an organic or inorganic source of alkalinity or a pH buffering agent. Nonlimiting examples include the alkali metal hydroxides, alkali metal carbonates, alkanolamines, and/or salts of weak organic acids. Suitable pH modifiers include sodium hydroxide, lithium hydroxide, potassium hydroxide, calcium hydroxide, sodium carbonate, lithium carbonate, potassium carbonate, and mixtures thereof. Suitable pH modifiers include acetate, formate, and the like. Suitable pH modifiers have no or only weak calcium sequestration capability at the pH of the use solution.

The pH modifier can be present at amounts of about 1 to about 70 wt-%, about 2 to about 50 wt-%, about 3 to about 30 wt-%, about 0.01 to about 60 wt-%, about 0.1 to about 30 wt-%, about 0.2 to about 15 wt-%, about 0.5 to about 10 wt-%, about 0.8 to about 8 wt-%, about 1 wt-% to about 6 wt-%, or about 2 wt-% to about 4 wt-%. It is to be understood that all values and ranges between these values and ranges are encompassed by the compositions of the present invention.

Processing Aid

In some embodiments, the compositions of the present invention further include a processing aid. Processing aids are materials which enhance the production process for the cleaning composition. They can serve as drying agents, modify the rate of solidification, alter the transfer of water of hydration in the formula, or even act as the solidifying matrix itself. Processing aids can have some overlap with other functionalities in the formula. Non limiting examples include silica, alkali metal silicates, urea, polyethylene glycols, solid surfactants, sodium carbonate, potassium chloride, sodium sulfate, sodium hydroxide, water, etc. Which processing aid(s) is suitable is dependent on, for example, the manufacturing procedure and specific cleaning composition.

The processing aid can be present at amounts of about 1 to about 70 wt-%, about 2 to about 50 wt-%, about 3 to about 30 wt-%, about 0.01 to about 60 wt-%, about 0.1 to about 30 wt-%, about 0.2 to about 15 wt-%, about 0.5 to about 10 wt-%, about 0.8 to about 8 wt-%, about 1 wt-% to about 6 wt-%, or about 2 wt-% to about 4 wt-%.

Active Oxygen Compounds

The active oxygen compound acts to provide a source of active oxygen, but can also act to form at least a portion of the solidification agent. The active oxygen compound can be inorganic or organic, and/or a mixture thereof. Some examples of active oxygen compound include peroxygen compounds, and peroxygen compound adducts.

Many active oxygen compounds are peroxygen compounds. Any peroxygen compound generally known can be used. Examples of suitable peroxygen compounds include inorganic and organic peroxygen compounds, or mixtures thereof.

The active oxygen compound can be in the present composition at amounts of about 0.1 to about 70 wt-%, about 1 to about 50 wt-%, or about 10 wt-% to about 30 wt-%.

Inorganic Active Oxygen Compound

Examples of inorganic active oxygen compounds include the following types of compounds or sources of these compounds, or alkali metal salts including these types of compounds, or forming an adduct therewith: hydrogen peroxide; group 1 (IA) active oxygen compounds, for example lithium peroxide, sodium peroxide, and the like; group 2 (IIA) active oxygen compounds, for example magnesium peroxide, calcium peroxide, strontium peroxide, barium peroxide, and the like; group 12 (IIB) active oxygen compounds, for example zinc peroxide, and the like; group 13 (IIIA) active oxygen compounds, for example boron compounds, such as perborates, for example sodium perborate hexahydrate of the formula $Na_2[B_2(O_2)_2(OH)_4].6H_2O$ (also called sodium perborate tetrahydrate and formerly written as $NaBO_3.4H_2O$); sodium peroxyborate tetrahydrate of the formula $Na_2B_2(O_2)_2[(OH)_4].4H_2O$ (also called sodium perborate trihydrate, and formerly written as $NaBO_3.3H_2O$); sodium peroxyborate of the formula $Na_2[B_2(O_2)_2(OH)_4]$ (also called sodium perborate monohydrate and formerly written as $NaBO_3.H_2O$); and the like; e.g., perborate; group 14 (IVA) active oxygen compounds, for example persilicates and peroxycarbonates, which are also called percarbonates, such as persilicates or peroxycarbonates of alkali metals; and the like; e.g., percarbonate, e.g., persilicate; group 15 (VA) active oxygen compounds, for example peroxynitrous acid and its salts; peroxyphosphoric acids and their salts, for example, perphosphates; and the like; e.g., perphosphate; group 16 (VIA) active oxygen compounds, for example peroxysulfuric acids and their salts, such as peroxymonosulfuric and peroxydisulfuric acids, and their salts, such as persulfates, for example, sodium persulfate; and the like; e.g., persulfate; group VIIa active oxygen compounds such as sodium periodate, potassium perchlorate and the like.

Other active inorganic oxygen compounds can include transition metal peroxides; and other such peroxygen compounds, and mixtures thereof.

In certain embodiments, the compositions and methods of the present invention employ certain of the inorganic active oxygen compounds listed above. Suitable inorganic active oxygen compounds include hydrogen peroxide, hydrogen peroxide adduct, group IIIA active oxygen compounds, group VIA active oxygen compound, group VA active oxygen compound, group VIIA active oxygen compound, or mixtures thereof. Examples of such inorganic active oxygen compounds include percarbonate, perborate, persulfate, perphosphate, persilicate, or mixtures thereof. Hydrogen peroxide presents an example of an inorganic active oxygen compound. Hydrogen peroxide can be formulated as a mixture of hydrogen peroxide and water, e.g., as liquid hydrogen peroxide in an aqueous solution. The mixture of solution can include about 5 to about 40 wt-% hydrogen peroxide or 5 to 50 wt-% hydrogen peroxide.

In an embodiment, the inorganic active oxygen compounds include hydrogen peroxide adduct. For example, the inorganic active oxygen compounds can include hydrogen peroxide, hydrogen peroxide adduct, or mixtures thereof. Any of a variety of hydrogen peroxide adducts are suitable for use in the present compositions and methods. For example, suitable hydrogen peroxide adducts include percarbonate salt, urea peroxide, peracetyl borate, an adduct of $H_2O_2$ and polyvinyl pyrrolidone, sodium percarbonate, potassium percarbonate, mixtures thereof, or the like. Suitable hydrogen peroxide adducts include percarbonate salt, urea peroxide, peracetyl borate, an adduct of $H_2O_2$ and polyvinyl pyrrolidone, or mixtures thereof. Suitable hydrogen peroxide adducts include sodium percarbonate, potassium percarbonate, or mixtures thereof, e.g., sodium percarbonate.

Organic Active Oxygen Compound

Any of a variety of organic active oxygen compounds can be employed in the compositions and methods of the present invention. For example, the organic active oxygen compound can be a peroxycarboxylic acid, such as a mono- or di-peroxycarboxylic acid, an alkali metal salt including these types of compounds, or an adduct of such a compound. Suitable peroxycarboxylic acids include $C_1$-$C_{24}$ peroxycarboxylic acid, salt of $C_1$-$C_{24}$ peroxycarboxylic acid, ester of $C_1$-$C_{24}$ peroxycarboxylic acid, diperoxycarboxylic acid, salt of diperoxycarboxylic acid, ester of diperoxycarboxylic acid, or mixtures thereof.

Suitable peroxycarboxylic acids include $C_1$-$C_{10}$ aliphatic peroxycarboxylic acid, salt of $C_1$-$C_{10}$ aliphatic peroxycarboxylic acid, ester of $C_1$-$C_{10}$ aliphatic peroxycarboxylic acid, or mixtures thereof; e.g., salt of or adduct of peroxyacetic acid; e.g., peroxyacetyl borate. Suitable diperoxycarboxylic acids include $C_4$-$C_{10}$ aliphatic diperoxycarboxylic acid, salt of $C_4$-$C_{10}$ aliphatic diperoxycarboxylic acid, or ester of $C_4$-$C_{10}$ aliphatic diperoxycarboxylic acid, or mixtures thereof; e.g., a sodium salt of perglutaric acid, of persuccinic acid, of peradipic acid, or mixtures thereof.

Organic active oxygen compounds include other acids including an organic moiety. Suitable organic active oxygen compounds include perphosphonic acids, perphosphonic acid salts, perphosphonic acid esters, or mixtures or combinations thereof.

Active Oxygen Compound Adducts

Active oxygen compound adducts include any generally known and that can function, for example, as a source of active oxygen and as part of the composition. Hydrogen peroxide adducts, or peroxyhydrates, are suitable. Some examples of source of alkalinity adducts include the following: alkali metal percarbonates, for example sodium percarbonate (sodium carbonate peroxyhydrate), potassium percarbonate, rubidium percarbonate, cesium percarbonate, and the like; ammonium carbonate peroxyhydrate, and the like; urea peroxyhydrate, peroxyacetyl borate; an adduct of $H_2O_2$ polyvinyl pyrrolidone, and the like, and mixtures of any of the above.

Glass and Metal Corrosion Inhibitors

The cleaning composition can include a metal corrosion inhibitor in an amount up to about 50 wt-%, about 1 to about 40 wt-%, or about 3 to about 30 wt-%. The corrosion inhibitor is included in the composition in an amount sufficient to provide a use solution that exhibits a rate of corrosion and/or etching of glass that is less than the rate of corrosion and/or etching of glass for an otherwise identical use solution except for the absence of the corrosion inhibitor. It is expected that the use solution will include at least about 6 parts per million (ppm) of the corrosion inhibitor to provide desired corrosion inhibition properties. It is expected that larger amounts of corrosion inhibitor can be used in the use solution without deleterious effects. It is expected that at a certain point, the additive effect of increased corrosion and/or etching resistance with increasing corrosion inhibitor concentration will be lost, and additional corrosion inhibitor will simply increase the cost of using the solid cleaning composition.

The use solution can include about 6 ppm to about 300 ppm of the corrosion inhibitor or about 20 ppm to about 200 ppm of the corrosion inhibitor when used to inhibit the corrosion of glass. When used to inhibit the corrosion of metals, e.g., aluminum, the use solution can include about 10 to about 2000 ppm, about 100 to about 1500 ppm, or about 500 to about 1200 ppm of the corrosion inhibitor. Examples of suitable corrosion inhibitors include, but are not limited to: a combination of a source of aluminum ion and a source of zinc ion, as well as an alkaline metal silicate or hydrate thereof.

The corrosion inhibitor can refer to the combination of a source of aluminum ion and a source of zinc ion. The source of aluminum ion and the source of zinc ion provide aluminum ion and zinc ion, respectively, when the solid cleaning composition is provided in the form of a use solution. The amount of the corrosion inhibitor is calculated based upon the combined amount of the source of aluminum ion and the source of zinc ion. Anything that provides an aluminum ion in a use solution can be referred to as a source of aluminum ion, and anything that provides a zinc ion when provided in a use solution can be referred to as a source of zinc ion. It is not necessary for the source of aluminum ion and/or the source of zinc ion to react to form the aluminum ion and/or the zinc ion. Aluminum ions can be considered a source of aluminum ion, and zinc ions can be considered a source of zinc ion. The source of aluminum ion and the source of zinc ion can be provided as organic salts, inorganic salts, and mixtures thereof.

Suitable sources of aluminum ion include, but are not limited to: aluminum salts such as sodium aluminate, aluminum bromide, aluminum chlorate, aluminum chloride, aluminum iodide, aluminum nitrate, aluminum sulfate, aluminum acetate, aluminum formate, aluminum tartrate, aluminum lactate, aluminum oleate, aluminum bromate, aluminum borate, aluminum potassium sulfate, aluminum zinc sulfate, and aluminum phosphate.

Suitable sources of zinc ion include, but are not limited to: zinc salts such as zinc chloride, zinc sulfate, zinc nitrate, zinc iodide, zinc thiocyanate, zinc fluorosilicate, zinc dichromate, zinc chlorate, sodium zincate, zinc gluconate, zinc acetate, zinc benzoate, zinc citrate, zinc lactate, zinc formate, zinc bromate, zinc bromide, zinc fluoride, zinc fluorosilicate, and zinc salicylate.

By controlling the ratio of the aluminum ion to the zinc ion in the use solution, it is possible to provide reduced corrosion and/or etching of glassware and ceramics compared with the use of either component alone. That is, the combination of the aluminum ion and the zinc ion can provide a synergy in the reduction of corrosion and/or etching. The ratio of the source of aluminum ion to the source of zinc ion can be controlled to provide a synergistic effect. In general, the weight ratio of aluminum ion to zinc ion in the use solution can be at least about 6:1, can be less than about 1:20, and can be about 2:1 and about 1:15.

An effective amount of an alkaline metal silicate or hydrate thereof can be employed in the compositions and methods of the invention to form a composition having metal protecting capacity. The silicates employed in the compositions of the invention are those that have conventionally been used in cleaning formulations. For example, typical alkali metal silicates are those powdered, particulate or granular silicates which are either anhydrous or, for example, which contain water of hydration (e.g., about 5% to about 25 wt-%, about 15% to about 20 wt-% water of hydration). These silicates can be sodium silicates and have a $Na_2O:SiO_2$ ratio of about 1:1 to about 1:5, respectively, and typically contain available water in the amount of from about 5% to about 25 wt-%. In general, the silicates have a $Na_2O:SiO_2$ ratio of about 1:1 to about 1:3.75, about 1:1.5 to about 1:3.75 and most about 1:1.5 to about 1:2.5. A silicate with a $Na_2O:SiO_2$ ratio of about 1:2 and about 16% to about 22 wt-% water of hydration, is suitable. For example, such silicates are available in powder form as GD Silicate and in granular form as Britesil H-20, available from PQ Corporation, Valley Forge, Pa. These ratios may be obtained with single silicate compositions or combinations of silicates which upon combination result in the suitable ratio. The hydrated silicates at suitable ratios, a $Na_2O:SiO_2$ ratio of about 1:1.5 to about 1:2.5, have been found to provide the optimum metal protection and rapidly form a solid cleaning composition. Hydrated silicates are suitable.

Silicates can be included in the composition to provide for metal protection but are additionally known to provide alkalinity and additionally function as anti-redeposition agents. Suitable silicates include, but are not limited to: sodium silicate and potassium silicate. The compositions of the present invention can be provided without silicates, but when silicates are included, they can be included in amounts that provide for desired metal protection. The composition can include silicates in amounts of at least about 1 wt-%, at least about 5 wt-%, at least about 10 wt-%, and at least about 15 wt-%. In addition, in order to provide sufficient room for other components in the composition, the silicate component can be provided at a level of less than about 20 wt-%, less than about 25 wt-%, less than about 20 wt-%, or less than about 15 wt-%.

Antimicrobials

Antimicrobial agents are chemical compositions that when used in a composition alone, or in combination with other components, act to reduce or prevent microbial contamination and deterioration of commercial products, material systems, surfaces, etc. In some aspects, these materials fall in specific classes including phenolics, halogen compounds, quaternary ammonium compounds, metal derivatives, amines, alkanol amines, nitro derivatives, analides, organosulfur and sulfur-nitrogen compounds and miscellaneous compounds.

It should also be understood that the source of alkalinity used in the formation of compositions embodying the invention also act as antimicrobial agents, and can even provide sanitizing activity. In fact, in some embodiments, the ability of the source of alkalinity to act as an antimicrobial agent reduces the need for secondary antimicrobial agents within the composition. For example, percarbonate compositions have been demonstrated to provide excellent antimicrobial action. Nonetheless, some embodiments incorporate additional antimicrobial agents.

The given antimicrobial agent, depending on chemical composition and concentration, may simply limit further proliferation of numbers of the microbe or may destroy all or a portion of the microbial population. The terms "microbes" and "microorganisms" typically refer primarily to bacteria, virus, yeast, spores, and fungus microorganisms. In use, the antimicrobial agents are typically formed into a solid functional material that when diluted and dispensed, optionally, for example, using an aqueous stream forms an aqueous disinfectant or sanitizer composition that can be contacted with a variety of surfaces resulting in prevention of growth or the killing of a portion of the microbial population. A three log reduction of the microbial population results in a sanitizer composition. The antimicrobial agent can be encapsulated, for example, to improve its stability.

Common antimicrobial agents include phenolic antimicrobials such as pentachlorophenol, orthophenylphenol, a chloro-p-benzylphenol, p-chloro-m-xylenol. Halogen containing antibacterial agents include sodium trichloroisocyanurate, sodium dichloro isocyanate (anhydrous or dihydrate), iodine-poly(vinylpyrrolidinone) complexes, bromine compounds such as 2-bromo-2-nitropropane-1,3-diol, and quaternary antimicrobial agents such as benzalkonium chloride, didecyldimethyl ammonium chloride, choline diiodochloride, tetramethyl phosphonium tribromide. Other antimicrobial compositions such as hexahydro-1,3,5-tris(2-hydroxyethyl)-s-triazine, dithiocarbamates such as sodium dimethyldithiocarbamate, and a variety of other materials are known in the art for their anti-microbial properties. In some embodiments, an antimicrobial component, such as tetraacetylethylene diamine (TAED) can be included in the range of about 0.001 to about 75 wt-% of the composition, about 0.01 to about 20 wt-%, or about 0.05 to about 10 wt-%.

If present in compositions, the additional antimicrobial agent can be about 0.01 to about 30 wt-% of the composition, about 0.05 to about 10 wt-%, or about 0.1 to about 5 wt-%. In a use solution the additional antimicrobial agent can be about 0.001 to about 5 wt-% of the composition, about 0.01 to about 2 wt-%, or about 0.05 to about 0.5 wt-%.

Activators

In some embodiments, the antimicrobial activity or bleaching activity of the composition can be enhanced by the addition of a material which, when the composition is placed in use, reacts with the active oxygen to form an activated component. For example, in some embodiments, a peracid or a peracid salt is formed. For example, in some embodiments, tetraacetylethylene diamine can be included within the composition to react with the active oxygen and form a peracid or a peracid salt that acts as an antimicrobial agent. Other examples of active oxygen activators include transition metals and their compounds, compounds that contain a carboxylic, nitrile, or ester moiety, or other such compounds known in the art. In an embodiment, the activator includes tetraacetylethylene diamine; transition metal; compound that includes carboxylic, nitrile, amine, or ester moiety; or mixtures thereof.

In some embodiments, an activator component can be included in the range of 0.001 to 75 wt-%, about 0.01 to about 20 wt-%, or about 0.05 to about 10 wt-% of the composition. In an embodiment, the activator for the source of alkalinity combines with the active oxygen to form an antimicrobial agent.

Rinse Aid Functional Materials

Functional materials of the invention can include a formulated rinse aid composition containing a wetting or sheeting agent combined with other optional ingredients in a solid made using the complex of the invention. The rinse aid component for use with the compositions of the present invention can include a water soluble or dispersible low foaming organic material capable of reducing the surface tension of the rinse water to promote sheeting action and to prevent spotting or streaking caused by beaded water after rinsing is completed. This is often used in warewashing processes. Such sheeting agents are typically organic surfactant-like materials having a characteristic cloud point. The cloud point of the surfactant rinse or sheeting agent is defined as the temperature at which a 1 wt-% aqueous solution of the surfactant turns cloudy when warmed.

There are two general types of rinse cycles in commercial warewashing machines, a first type generally considered a sanitizing rinse cycle uses rinse water at a temperature of about 180° F., about 80° C. or higher. A second type of non-sanitizing machine uses a lower temperature non-sanitizing rinse, typically at a temperature of about 125° F., about 50° C. or higher. Surfactants useful in these applications are aqueous rinses having a cloud point greater than the available hot service water. Accordingly, the lowest useful cloud point measured for the surfactants of the invention is approximately 40° C. The cloud point can also be 60° C. or higher, 70° C. or higher, 80° C. or higher, etc., depending on the use locus hot water temperature and the temperature and type of rinse cycle.

Suitable sheeting agents, typically include a polyether compound prepared from ethylene oxide, propylene oxide, or a mixture in a homopolymer or block or heteric copolymer structure. Such polyether compounds are known as polyalkylene oxide polymers, polyoxyalkylene polymers or polyalkylene glycol polymers. Such sheeting agents require a region of relative hydrophobicity and a region of relative hydrophilicity to provide surfactant properties to the molecule. Such sheeting agents have a molecular weight in the range of about 500 to 15,000. Certain types of (PO)(EO) polymeric rinse aids have been found to be useful containing at least one block of poly(PO) and at least one block of poly(EO) in the polymer molecule. Additional blocks of poly(EO), poly(PO) or random polymerized regions can be formed in the molecule.

Particularly useful polyoxypropylene polyoxyethylene block copolymers are those including a center block of polyoxypropylene units and blocks of polyoxyethylene units to each side of the center block. Such polymers have the formula shown below:

$$(EO)_n—(PO)_m-(EO)_n$$

wherein n is an integer of 20 to 60, each end is independently an integer of 10 to 130. Another useful block copolymer are block copolymers having a center block of polyoxyethylene units and blocks of polyoxypropylene to each side of the center block. Such copolymers have the formula:

$$(PO)_n-(EO)_m—(PO)_n$$

wherein m is an integer of 15 to 175 and each end are independently integers of about 10 to 30. The solid functional materials of the invention can often use a hydrotrope to aid in maintaining the solubility of sheeting or wetting agents. Hydrotropes can be used to modify the aqueous solution creating increased solubility for the organic material. Suitable hydrotropes are low molecular weight aromatic sulfonate materials such as xylene sulfonates and dialkyldiphenyl oxide sulfonate materials.

In an embodiment, compositions according to the present invention provide desirable rinsing properties in ware washing without employing a separate rinse agent in the rinse cycle. For example, good rinsing occurs using such compositions in the wash cycle when rinsing employs just soft water.

The rinse aid functional material can be in the present in the compositions of the present invention at amounts of about 0.1 to about 15 wt-%, about 1 to about 10 wt-%, or about 2 wt-% to about 8 wt-%.

Additional Bleaching Agents

Additional bleaching agents for use in inventive formulations for lightening or whitening a substrate, include bleaching compounds capable of liberating an active halogen species, such as $Cl_2$, $Br_2$, $I_2$, $ClO_2$, $BrO_2$, $IO_2$, —$OCl^-$, —$OBr^-$ and/or, —$OI^-$, under conditions typically encountered during the cleansing process. Suitable bleaching agents for use in the present cleaning compositions include, for example, chlorine-containing compounds such as a chlorite, a hypochlorite, chloramine. Suitable halogen-releasing compounds include the alkali metal dichloroisocyanurates, chlorinated trisodium phosphate, the alkali metal hypochlorites, alkali metal chlorites, monochloroamine and dichloroamine, and the like, and mixtures thereof. Encapsulated chlorine sources may also be used to enhance the stability of the chlorine source in the composition (see, for example, U.S. Pat. Nos. 4,618,914 and 4,830,773, the disclosure of which is incorporated by reference herein). A bleaching agent may also be an additional peroxygen or active oxygen source such as hydrogen peroxide, perborates, for example sodium perborate mono and tetrahydrate, sodium carbonate peroxyhydrate, phosphate peroxyhydrates, and potassium permonosulfate, with and without activators such as tetraacetylethylene diamine, and the like, as discussed above.

A cleaning composition may include a minor but effective additional amount of a bleaching agent above that already available from the stabilized source of alkalinity, e.g., about 0.1 to about 10 wt-% or about 1 to about 6 wt-%. The present compositions can include bleaching agent in an amount of about 0.1 to about 60 wt-%, about 1 to about 20 wt-%, about 3 to about 8 wt-%, or about 3 to about 6 wt-%.

Hardening Agents

The cleaning compositions may also include a hardening agent. A hardening agent is a compound or system of compounds, organic or inorganic, which significantly contributes to the uniform solidification of the composition. The hardening agents should be compatible with the cleaning agent and other active ingredients of the composition and should be capable of providing an effective amount of hardness and/or aqueous solubility to the processed cleaning composition. The hardening agents should also be capable of forming a homogeneous matrix with the cleaning agent and other ingredients when mixed and solidified to provide a uniform dissolution of the cleaning agent from the cleaning composition during use.

The amount of hardening agent included in the cleaning composition will vary according to factors including, but not limited to: the type of cleaning composition being prepared, the ingredients of the cleaning composition, the intended use of the cleaning composition, the quantity of dispensing solution applied to the cleaning composition over time during use, the temperature of the dispensing solution, the hardness of the dispensing solution, the physical size of the cleaning composition, the concentration of the other ingredients, and the concentration of the cleaning agent in the composition. The amount of the hardening agent included in the solid cleaning composition should be effective to combine with the cleaning agent and other ingredients of the composition to form a homogeneous mixture under continuous mixing conditions and a temperature at or below the melting temperature of the hardening agent.

The hardening agent may also form a matrix with the cleaning agent and other ingredients which will harden to a solid form under ambient temperatures of about 30° C. to about 50° C., particularly about 35° C. to about 45° C., after mixing ceases and the mixture is dispensed from the mixing system, within about 1 minute to about 3 hours, particularly about 2 minutes to about 2 hours, and particularly about 5 minutes to about 1 hour. A minimal amount of heat from an external source may be applied to the mixture to facilitate processing of the mixture. The amount of the hardening agent included in the cleaning composition should be effective to provide a desired hardness and desired rate of controlled solubility of the processed composition when placed in an aqueous medium to achieve a desired rate of dispensing the cleaning agent from the solidified composition during use.

The hardening agent may be an organic or an inorganic hardening agent. A particular organic hardening agent is a polyethylene glycol (PEG) compound. The solidification rate of cleaning compositions including a polyethylene glycol hardening agent will vary, at least in part, according to the amount and the molecular weight of the polyethylene glycol added to the composition. Examples of suitable polyethylene glycols include, but are not limited to: solid polyethylene glycols of the general formula $H(OCH_2CH_2)_nOH$, where n is greater than 15, more particularly about 30 to about 1700. Typically, the polyethylene glycol is a solid in the form of a free-flowing powder or flakes, having a molecular weight of about 1,000 to about 100,000, particularly having a molecular weight of at least about 1,450 to about 20,000, more particularly between about 1,450 to about 8,000. The polyethylene glycol is present at a concentration of from about 1% to about 75% by weight and particularly about 3% to about 15% by weight. Suitable polyethylene glycol compounds include, but are not limited to: PEG 4000, PEG 1450, and PEG 8000 among others, with PEG 4000 and PEG 8000 being most preferred. An example of a commercially available solid polyethylene glycol includes, but is not limited to: CARBOWAX, available from Union Carbide Corporation, Houston, Tex.

Particular inorganic hardening agents are hydratable inorganic salts, including, but not limited to: sulfates, acetates, and bicarbonates. In an exemplary embodiment, the inorganic hardening agents are present at concentrations of up to about 50% by weight, particularly about 5% to about 25% by weight, and more particularly about 5% to about 15% by weight.

Urea particles may also be employed as hardeners in the cleaning compositions. The solidification rate of the compositions will vary, at least in part, depending on the amount, particle size, and shape of the urea added to the cleaning composition. For example, a particulate form of urea may be combined with a cleaning agent and other ingredients, as well as a minor but effective amount of water. The amount and particle size of the urea is effective to combine with the cleaning agent and other ingredients to form a homogeneous mixture without the application of heat from an external source to melt the urea and other ingredients to a molten stage. The amount of urea included in the cleaning composition should be effective to provide a desired hardness and desired rate of solubility of the composition when placed in an aqueous medium to achieve a desired rate of dispensing the cleaning agent from the solidified composition during use. In an exemplary embodiment, the cleaning composition includes between about 5% to about 90% by weight urea, particularly between about 8% and about 40% by weight urea, and more particularly between about 10% and about 30% by weight urea.

The urea may be in the form of prilled beads or powder. Prilled urea is generally available from commercial sources as a mixture of particle sizes ranging from about 8-15 U.S. mesh, as for example, from Arcadian Sohio Company, Nitrogen Chemicals Division. A prilled form of urea is milled to reduce the particle size to about 50 U.S. mesh to about 125 U.S. mesh, particularly about 75-100 U.S. mesh, particularly using a wet mill such as a single or twin-screw extruder, a Teledyne mixer, a Ross emulsifier, and the like.

Secondary Hardening Agents/Solubility Modifiers.

The present compositions may include a minor but effective amount of a secondary hardening agent, as for example, an amide such stearic monoethanolamide or lauric diethanolamide, or an alkylamide, and the like; a solid polyethylene glycol, or a solid EO/PO block copolymer, and the like; starches that have been made water-soluble through an acid or alkaline treatment process; various inorganics that impart solidifying properties to a heated composition upon cooling, and the like. Such compounds may also vary the solubility of the composition in an aqueous medium during use such that the cleaning agent and/or other active ingredients may be dispensed from the solid composition over an extended period of time. The composition may include a secondary hardening agent in an amount of about 5 to about 20 wt-% or about 10 to about 15 wt-%.

Fillers

A cleaning composition may include an effective amount of one or more of a filler which does not perform as a cleaning agent per se, but cooperates with the cleaning agent to enhance the overall processability of the composition. Examples of fillers suitable for use in the present cleaning compositions include sodium sulfate, sodium chloride, starch, sugars, $C_1$-$C_{10}$ alkylene glycols such as propylene glycol, and the like. A filler such as a sugar (e.g. sucrose) can aid dissolution of a solid composition by acting as a disintegrant. A filler can be included in an amount up to about 50 wt-%, of about 1 to about 20 wt-%, about 3 to about 15 wt-%, about 1 to about 30 wt-%, or about 1.5 to about 25 wt-%.

Defoaming Agents

An effective amount of a defoaming agent for reducing the stability of foam may also be included in the present cleaning compositions. The cleaning composition can include about 0.0001-5 wt-% of a defoaming agent, e.g., about 0.01-3 wt-%. The defoaming agent can be provided in an amount of about 0.0001% to about 10 wt-%, about 0.001% to about 5 wt-%, or about 0.01% to about 1.0 wt-%.

Examples of defoaming agents suitable for use in the present compositions include silicone compounds such as silica dispersed in polydimethylsiloxane, EO/PO block copolymers, alcohol alkoxylates, fatty amides, hydrocarbon waxes, fatty acids, fatty esters, fatty alcohols, fatty acid soaps, ethoxylates, mineral oils, polyethylene glycol esters, alkyl phosphate esters such as monostearyl phosphate, and the like. A discussion of defoaming agents may be found, for example, in U.S. Pat. No. 3,048,548 to Martin et al., U.S. Pat. No. 3,334,147 to Brunelle et al., and U.S. Pat. No. 3,442,242 to Rue et al., the disclosures of which are incorporated by reference herein.

Anti-Redeposition Agents

The cleaning compositions of the present invention can also include an anti-redeposition agent capable of facilitating sustained suspension of soils in a cleaning solution and preventing the removed soils from being redeposited onto the substrate being cleaned. Examples of suitable anti-redeposition agents include fatty acid amides, fluorocarbon surfactants, complex phosphate esters, styrene maleic anhydride copolymers, and cellulosic derivatives such as hydroxyethyl cellulose, hydroxypropyl cellulose, and the like. In some embodiments, the cleaning compositions can include about 0.5 to about 10 wt-%, e.g., about 1 to about 5 wt-%, of an anti-redeposition agent.

Optical Brighteners

Optical brightener is also referred to as fluorescent whitening agents or fluorescent brightening agents provide optical compensation for the yellow cast in fabric substrates. With optical brighteners yellowing is replaced by light emitted from optical brighteners present in the area commensurate in scope with yellow color. The violet to blue light supplied by the optical brighteners combines with other light reflected from the location to provide a substantially complete or enhanced bright white appearance. This additional light is produced by the brightener through fluorescence. Optical brighteners absorb light in the ultraviolet range 275 through 400 nm and emit light in the ultraviolet blue spectrum 400-500 nm.

Fluorescent compounds belonging to the optical brightener family are typically aromatic or aromatic heterocyclic materials often containing condensed ring system. An important feature of these compounds is the presence of an uninterrupted chain of conjugated double bonds associated with an aromatic ring. The number of such conjugated double bonds is dependent on substituents as well as the planarity of the fluorescent part of the molecule. Most brightener compounds are derivatives of stilbene or 4,4'-diamino stilbene, biphenyl, five membered heterocycles (triazoles, oxazoles, imidazoles, etc.) or six membered heterocycles (cumarins, naphthalamides, triazines, etc.). The choice of optical brighteners for use in cleaning compositions will depend upon a number of factors, such as the type of composition, the nature of other components present in the composition, the temperature of the wash water, the degree of agitation, and the ratio of the material washed to the tub size. The brightener selection is also dependent upon the type of material to be cleaned, e.g., cottons, synthetics, etc. Since most laundry products are used to clean a variety of fabrics, the compositions may contain a mixture of brighteners which are effective for a variety of fabrics. It is of course necessary that the individual components of such a brightener mixture be compatible.

Optical brighteners useful in the present invention are commercially available and will be appreciated by those skilled in the art. Commercial optical brighteners which may be useful in the present invention can be classified into subgroups, which include, but are not necessarily limited to, derivatives of stilbene, pyrazoline, coumarin, carboxylic acid, methinecyanines, dibenzothiophene-5,5-dioxide, azoles, 5- and 6-membered-ring heterocycles and other miscellaneous agents. Examples of these types of brighteners are disclosed in "The Production and Application of Fluorescent Brightening Agents", M. Zahradnik, Published by John Wiley & Sons, New York (1982), the disclosure of which is incorporated herein by reference.

Stilbene derivatives which may be useful in the present invention include, but are not necessarily limited to, derivatives of bis(triazinyl)amino-stilbene; bisacylamino derivatives of stilbene; triazole derivatives of stilbene; oxadiazole derivatives of stilbene; oxazole derivatives of stilbene; and styryl derivatives of stilbene.

For laundry cleaning or sanitizing compositions, suitable optical brighteners include stilbene derivatives, which can be employed at concentrations of up to 5 wt-%.

Stabilizing Agents

In some embodiments, of the present invention, the cleaning composition can also include a stabilizing agent. Examples of suitable stabilizing agents include, but are not limited to: borate, calcium/magnesium ions, propylene glycol, and mixtures thereof. The composition need not include a stabilizing agent, but when the composition includes a stabilizing agent, it can be included in an amount that provides the desired level of stability of the composition. Suitable ranges of the stabilizing agent include up to about 20 wt-%, about 0.5 to about 15 wt-%, or about 2 to about 10 wt-%.

Dispersants

The compositions of the present invention can also include a dispersant. Examples of suitable dispersants that can be used in the composition include, but are not limited to: maleic acid/olefin copolymers, polyacrylic acid, and mixtures thereof. The composition need not include a dispersant, but when a dispersant is included it can be included in an amount that provides the desired dispersant properties. Suitable ranges of the dispersant in the composition can be up to about 20 wt-%, about 0.5 to about 15 wt-%, or about 2 to about 9 wt-%.

Enzymes

In some embodiments, the compositions of the present invention can include an enzyme. Enzymes that can be included in the compositions of the present invention include those enzymes that aid in the removal of starch and/or protein stains. Suitable types of enzymes include, but are not limited to: proteases, alpha-amylases, and mixtures thereof. Suitable proteases that can be used include, but are not limited to: those derived from *Bacillus licheniformis, Bacillus lenus, Bacillus alcalophilus*, and *Bacillus amyloliquefacins*. Suitable alpha-amylases include *Bacillus subtilis, Bacillus amyloliquefaciens*, and *Bacillus licheniformis*. The composition need not include an enzyme, but when the composition includes an enzyme, it can be included in an amount that provides the desired enzymatic activity when the solid composition is provided as a use composition. Suitable ranges of the enzyme in the composition include up to about 15 wt-%, about 0.5 to about 10 wt-%, or about 1 to about 5 wt-%.

Thickeners

The compositions of the present invention can include a rheology modifier or a thickener. The rheology modifier may provide the following functions: increasing the viscosity of the compositions; increasing the particle size of liquid use solutions when dispensed through a spray nozzle; providing the use solutions with vertical cling to surfaces; providing particle suspension within the use solutions; or reducing the evaporation rate of the use solutions.

The rheology modifier may provide a use composition that is pseudo plastic, in other words the use composition or material when left undisturbed, retains a high viscosity. However, when sheared, the viscosity of the material is substantially but reversibly reduced. After the shear action is removed, the viscosity returns. These properties permit the application of the material through a spray head. When sprayed through a nozzle, the material undergoes shear as it is drawn up a feed tube into a spray head under the influence of pressure and is sheared by the action of a pump in a pump action sprayer. In either case, the viscosity can drop to a point such that substantial quantities of the material can be applied using the spray devices used to apply the material to a soiled surface.

However, once the material comes to rest on a soiled surface, the materials can regain high viscosity to ensure that the material remains in place on the soil. In an embodiment, the material can be applied to a surface resulting in a substantial coating of the material that provides the cleaning components in sufficient concentration to result in lifting and removal of the hardened or baked-on soil. While in contact with the soil on vertical or inclined surfaces, the thickeners in conjunction with the other components of the cleaner minimize dripping, sagging, slumping or other movement of the material under the effects of gravity. The material should be formulated such that the viscosity of the material is adequate to maintain contact substantial quantities of the film of the material with the soil for at least a minute, five minutes or more.

Examples of suitable thickeners or rheology modifiers are polymeric thickeners including, but not limited to: polymers or natural polymers or gums derived from plant or animal sources. Such materials may be polysaccharides such as large polysaccharide molecules having substantial thickening capacity. Thickeners or rheology modifiers also include clays.

A substantially soluble polymeric thickener can be used to provide increased viscosity or increased conductivity to the use compositions. Examples of polymeric thickeners for the aqueous compositions of the invention include, but are not limited to: carboxylated vinyl polymers such as polyacrylic acids and sodium salts thereof, ethoxylated cellulose, polyacrylamide thickeners, xanthan compositions, sodium alginate and algin products, hydroxypropyl cellulose, hydroxyethyl cellulose, and other similar aqueous thickeners that have some substantial proportion of water solubility. Examples of suitable commercially available thickeners include, but are not limited to: Acusol, available from Rohm & Haas Company, Philadelphia, Pa.; and Carbopol, available from B.F. Goodrich, Charlotte, N.C.

Examples of suitable polymeric thickeners include, but not limited to: polysaccharides. An example of a suitable commercially available polysaccharide includes, but is not limited to, Diutan, available from Kelco Division of Merck, San Diego, Calif. Thickeners for use in the compositions further include polyvinyl alcohol thickeners, such as, fully hydrolyzed (greater than 98.5 mol acetate replaced with the —OH function).

An example of a suitable polysaccharide includes, but is not limited to, xanthans. Such xanthan polymers are suitable due to their high water solubility, and great thickening power. Xanthan is an extracellular polysaccharide of *Xanthomonas campestras*. Xanthan may be made by fermentation based on corn sugar or other corn sweetener by-products. Xanthan includes a poly beta-(1-4)-D-Glucopyranosyl backbone chain, similar to that found in cellulose. Aqueous dispersions of xanthan gum and its derivatives exhibit novel and remarkable rheological properties. Low concentrations of the gum have relatively high viscosities which permit it to be used economically. Xanthan gum solutions exhibit high pseudo plasticity, i.e. over a wide range of concentrations, rapid shear thinning occurs that is generally understood to be instantaneously reversible. Non-sheared materials have viscosities that appear to be independent of the pH and independent of temperature over wide ranges. Suitable xanthan materials include crosslinked xanthan materials. Xanthan polymers can be crosslinked with a variety of known covalent reacting crosslinking agents reactive with the hydroxyl functionality of large polysaccharide molecules and can also be crosslinked using divalent, trivalent or polyvalent metal ions. Such crosslinked xanthan gels are disclosed in U.S. Pat. No. 4,782,901, which is herein incorporated by reference. Suitable crosslinking agents for xanthan materials include, but are not limited to: metal cations such as $Al^{+3}$, $Fe^{+3}$, $Sb^{+3}$, $Zr^{+4}$ and other transition metals. Examples of suitable commercially available xanthans include, but are not limited to:

KELTROL®, KELZAN® AR, KELZAN® D35, KELZAN® S, KELZAN® XZ, available from Kelco Division of Merck, San Diego, Calif. Known organic crosslinking agents can also be used. A suitable crosslinked xanthan is KELZAN® AR, which provides a pseudo plastic use solution that can produce large particle size mist or aerosol when sprayed.

The thickener can be in the present solid composition at amounts of about 0.1 to about 10 wt-%, about 0.5 to about 8 wt-%, or about 1 wt-% to about 5 wt-%.

Dyes/Odorants

Various dyes, odorants including perfumes, and other aesthetic enhancing agents may also be included in the composition. Dyes may be included to alter the appearance of the composition, as for example, Direct Blue 86 (Miles), Fastusol Blue (Mobay Chemical Corp.), Acid Orange 7 (American Cyanamid), Basic Violet 10 (Sandoz), Acid Yellow 23 (GAF), Acid Yellow 17 (Sigma Chemical), Sap Green (Keyston Analine and Chemical), Metanil Yellow (Keystone Analine and Chemical), Acid Blue 9 (Hilton Davis), Sandolan Blue/Acid Blue 182 (Sandoz), Hisol Fast Red (Capitol Color and Chemical), Fluorescein (Capitol Color and Chemical), Acid Green 25 (Ciba-Geigy), and the like.

Fragrances or perfumes that may be included in the compositions include, for example, terpenoids such as citronellol, aldehydes such as amyl cinnamaldehyde, a jasmine such as C1S-jasmine or jasmal, vanillin, and the like.

The dye or odorant can be in the present solid composition at amounts of about 0.01 to about 10 wt-%, about 0.1 to about 5 wt-%, or about 0.5 wt-% to about 3 wt-%.

Methods of Use

In some aspects the present invention provides methods for cleaning an article. In some embodiments, the method includes providing a cleaning composition. In some embodiments, the cleaning composition includes a threshold agent, i.e., a hydroxycarboxylate compound, or salt, ester, or anhydride thereof and an ingredient selected from the group consisting of a source of alkalinity, surfactant and a mixture thereof. In some embodiments, the cleaning compositions of the present invention do not require dilution prior to use for cleaning an article. In some embodiments the cleaning composition is diluted at a ratio of about 1000:1 diluent to cleaning composition. In other embodiments, the cleaning composition is diluted at a ratio of about 500:1 diluent to cleaning composition. In some embodiments, the cleaning composition is diluted with water.

In some embodiments, the methods of the present invention further include contacting an article with the wash solution, i.e., the diluted cleaning composition, such that the article is cleaned. In some embodiments, the temperature of the wash solution during the contacting step is between about 80° and about 140° F. In other embodiments, the temperature of the wash solution during the contacting is less than about 80° F. In still yet other embodiments, the temperature of the wash solution during contacting is about room temperature, e.g., between about 64° F. and about 75° F. It is to be understood that all values and ranges between these values and ranges are encompassed by the methods of the present invention.

In some embodiments, the methods of the present invention further include rinsing the article. The article can be rinsed by a variety of solutions, including, but not limited to, water, rinse aids, and combinations thereof. Any rinse additives or aids that reduce surface tension of the rinse water and promote sheeting of the water from the articles can be used.

In some embodiments, the methods of the present invention include rinsing an article with a rinse aid including a threshold agent including a hydroxycarboxylate compound. In some embodiments, the rinse aid includes about 10 ppm to about 100 ppm of a hydroxycarboxylate compound. In other embodiments, the rinse aid includes about 50 ppm to about 75 ppm of a hydroxycarboxylate compound. It is to be understood that all values and ranges between these values and ranges are encompassed by the present invention.

The cleaning compositions of the present invention can be used in a broad variety of applications including in industrial, household, health care, vehicle care and other such applications. Examples of applications include as a surface disinfectant, ware cleaning, laundry cleaning, laundry sanitizing, vehicle cleaning, floor cleaning, surface cleaning, pre-soaks, clean in place, rinse aids, and in a variety of other such applications.

In some aspects, the methods of the present invention include contacting an article with a wash solution including a diluted cleaning composition of the present invention. Contacting can include any of a variety of methods for applying such a composition, including, for example, spraying the wash solution, immersing the article in the wash solution, pouring the wash solution over the article, and any combination thereof. The compositions can be applied in a variety of areas including, but not limited to, kitchens, bathrooms, factories, offices, hospitals, car washes and food plants. The compositions can also be applied to any of a variety of hard surfaces have smooth, irregular or porous topography. Contacting can be both manual or by machine, or by any combination thereof.

The cleaning composition may be diluted with water at the location of use to provide the use solution. When the cleaning composition is used in an automatic warewashing or dishwashing machine, it is expected that that the location of use will be inside the automatic warewashing machine. For example, when the cleaning composition is used in a residential warewashing machine, the composition may be placed in the cleaning compartment of the warewashing machine. Depending on the machine, the cleaning may be provided in a unit dose form or in a multi-use form. In larger warewashing machines, a large quantity of cleaning composition may be provided in a compartment that allows for the release of a single dose amount of the cleaning composition for each wash cycle. Such a compartment may be provided as part of the warewashing machine or as a separate structure connected to the warewashing machine. For example, a block of the cleaning composition may be provided in a hopper and introduced into the warewashing machine when water is sprayed against the surface of the block to provide a liquid concentrate.

The cleaning composition may also be dispensed from a spray-type dispenser. Briefly, a spray-type dispenser functions by impinging a water spray upon an exposed surface of the cleaning composition to dissolve a portion of the cleaning composition, and then immediately directing the use solution out of the dispenser to a storage reservoir or directly to a point of use. When used, the product may be removed from the packaging (e.g. film) and inserted into the dispenser. The spray of water may be made by a nozzle in a shape that conforms to the shape of the solid cleaning composition. The dispenser enclosure may also closely fit the shape of the cleaning composition to prevent introducing and dispensing an incorrect cleaning composition.

Solid or aggregate compositions and methods embodying the invention are suitable for preparing a variety of solid compositions, as for example, a cast, extruded, molded or formed solid pellet, block, tablet, powder, granule, flake, and the like, or the formed solid or aggregate can thereafter be ground or formed into a powder, granule, flake, and the like.

In some embodiments, the solid composition can be formed to have a weight of 50 grams or less, while in other embodiments, the solid composition can be formed to have a weight of 5, 10, 15, 25, or 50 grams or greater, 500 grams or greater, or 1 kilogram or greater. For the purpose of this application the term "solid block" includes cast, formed, or extruded materials having a weight of 50 grams or greater. The solid compositions provide for a stabilized source of functional materials. In some embodiments, the solid composition can be dissolved, for example, in an aqueous or other medium, to create a concentrated and/or use solution. The solution can be directed to a storage reservoir for later use and/or dilution, or can be applied directly to a point of use.

The resulting solid composition can be used in any or a broad variety of applications, depending at least somewhat upon the particular functional materials incorporated into the composition. For example, in some embodiments, the solid composition can provide for a cleaning composition wherein a portion of the solid composition can be dissolved, for example, in an aqueous or other medium, to create a concentrated and/or use cleaning solution. The cleaning solution can be directed to a storage reservoir for later use and/or dilution, or can be applied directly to a point of use.

Exemplary articles that can be treated, i.e., cleaned, with the wash solution including a cleaning composition of the present invention and water include, but are not limited to motor vehicle exteriors, textiles, food contacting articles, clean-in-place (CIP) equipment, health care surfaces and hard surfaces. Exemplary motor vehicle exteriors include cars, trucks, trailers, buses, etc. that are commonly washed in commercial vehicle washing facilities. Exemplary textiles include, but are not limited to, those textiles that generally are considered within the term "laundry" and include clothes, towels, sheets, etc. In addition, textiles include curtains. Exemplary food contacting articles include, but are not limited to, dishes, glasses, eating utensils, bowls, cooking articles, food storage articles, etc. Exemplary CIP equipment includes, but is not limited to, pipes, tanks, heat exchangers, valves, distribution circuits, pumps, etc. Exemplary health care surfaces include, but are not limited to, surfaces of medical or dental devices or instruments. Exemplary hard surfaces include, but are not limited to, floors, counters, glass, mirrors, walls, etc. Hard surfaces can also include the inside of dish machines, and laundry machines. In general, hard surfaces can include those surfaces commonly referred to in the cleaning industry as environmental surfaces. Such hard surfaces can be made from a variety of materials including, for example, ceramic, metal, glass, wood or hard plastic.

In some embodiments, the compositions hereof will be formulated such that during use in aqueous cleaning operations the wash water will have a pH of between about 1 and about 14, about 6.5 to about 11, or 7-10.5. In some embodiments, the wash solution including a cleaning composition of the present invention will have a pH of 9 or greater. Techniques for controlling pH at recommended usage levels include the use of buffers, alkali, acids, etc., and are well known to those skilled in the art.

In some embodiments, the present invention provides compositions useful for removing soil from vehicles, e.g., cars, trucks, motorcycles. In some embodiments, the compositions include about 1 wt-% to about 10 wt-% of a hydroxycarboxylate threshold inhibitor, at least about 10 wt-% to about 50 wt-% of a source of alkalinity, about 1 wt-% to about 10 wt % of a surfactant, about 0 wt-% to about 20 wt-% of a builder, about 1 wt-% to about 10 wt-% of a hydroxycarboxylate, and about 5 wt-% to about 10 wt-% of an alkali metal silicate. The compositions may be diluted prior to use. For example, in some embodiments, the compositions are diluted with a diluent at a ratio of about 1 to about 1000 composition to diluent. In some embodiments, the diluent is water.

In some embodiments, the present compositions can be dispensed by immersing either intermittently or continuously in water. The compositions can then dissolve, for example, at a controlled or predetermined rate. The rate can be effective to maintain a concentration of dissolved cleaning agent that is effective for cleaning.

In some embodiments, the present compositions are a solid that can be dispensed by scraping solid from the solid composition and contacting the scrapings with water. The scrapings can be added to water to provide a concentration of dissolved cleaning agent that is effective for cleaning.

In some embodiments, the compositions of the present invention, i.e., compositions including a hydroxycarboxylate and a source of alkalinity, have at least a 95% transmittance when the solution is at a temperature of about 85° F. The transmittance of the compositions can be measured using any conventional turbidity measuring technique known in the art, or described herein. In other embodiments, the compositions have at least about a 95% transmittance at about 100° F. In yet other embodiments, the compositions have at least about an 80% transmittance at about 120° F. In still yet other embodiments, the compositions have at least about an 85% transmittance at about 140° F.

Those skilled in the art will recognize, or be able to ascertain using no more than routine experimentation, numerous equivalents to the specific procedures, embodiments, claims, and examples described herein. Such equivalents are considered to be within the scope of this invention and covered by the claims appended hereto. The contents of all references, patents, and patent applications cited throughout this application are hereby incorporated by reference. The invention is further illustrated by the following examples, which should not be construed as further limiting.

EXAMPLES

Example 1

Prevention of Calcium Precipitation

The ability of a hydroxycarboxylate to prevent calcium precipitation was compared to that of the known chelating agents ethylenediaminetetraacetic acid (EDTA) and nitrilotriacetic acid (NTA). The following solutions, shown in Table 1, were prepared.

TABLE 1

| Ingredient | Hydroxycarboxylate Formulation (wt-%) | EDTA Formulation (wt-%) | NTA Formulation (wt-%) |
|---|---|---|---|
| NaOH (50%) | 44.0 | 44.0 | 44.0 |
| KOH (45%) | 13.30 | 13.30 | 13.30 |
| Gluconic Acid (50%) | 3.00 | 3.00 | 3.00 |
| Acusol 445N | 1.00 | 1.00 | 1.00 |
| Dequest 2000 | 1.00 | 1.00 | 1.00 |
| Tartaric Acid | 2.47 | 0 | 0 |
| EDTA (40%) | 0 | 8 | 0 |
| NTA (40%) | 0 | 0 | 7.5 |

A 1% sodium oleate (1 g/100 g) solution was prepared. A hard water (375 ppm as $CaCO_3$)(22 gpg) solution was prepared.

To determine the ability of the above formulations to inhibit or prevent calcium precipitation, the formulations were mixed with 80 g of the hard water solution, 10 g of the sodium oleate solution, and water. 0.5 to 10 g of the formulations was added to the hard water and sodium oleate solutions in 0.5 g increments. Deionized (DI) water was added if needed to complete 100 grams of final mix. All test solutions had a pH of greater than 14.

The EDTA formulation was tested first. Test mixes were done using 0.5, 1.0, 1.5, 2.0, 2.5, 3.0, 3.5, 4.0, 4.5, and 5.0 g of the EDTA formulation. All of the test solutions had a precipitate with the exception of the solution containing 5 g of the EDTA formulation. However, that formulation did develop a slight precipitate after standing for a few minutes.

The hydroxycarboxylate formulation was then tested. Based on the above results, the formulation including 5 g of the hydroxycarboxylate was first tested. The order of addition was changed to make sure that any cloudiness was calcium oleate and not due to the alkalization of the Ca—Mg mix. Specifically, 80 g of the hard water was added to a glass bottle containing 5 g of the test formulation. The initial mixture was slightly cloudy, but after mixing it became clear. Then 10 g of the 1% sodium oleate solution was added, plus 5 g of deionized water. The final mix was cloudy, but did not have any precipitate in the bottom of the bottle.

5.5 g and a 6.0 g of the hydroxycarboxylate formulation were then tested. Test mixtures were prepared in the same order as described above for the 5.0 g hydroxycarboxylate formulation. However, when the sodium oleate solution was added to the clear mixture, the solution became cloudy and stayed cloudy even after deionized water was added to 100 g.

A 4 g test with the hydroxycarboxylate formulation was also run. Before adding the sodium oleate, the mix became cloudier. However, this mixture was still less cloudy than the mixtures with 5.0, 5.5, and 6.0 g of the hydroxycarboxylate formulation.

A test with 3 g of the hydroxycarboxylate formulation was also run. However, the mixture with hard water was cloudier than the mixture with 4 g of the hydroxycarboxylate formulation, and after adding the sodium oleate and DI water, the mix become the most cloudy of all of the previous mixtures.

Overall, it was observed that none of the test solutions using the hydroxycarboxylate formulation at any amount formed a precipitate. Although, they were cloudy, and slightly bluish in color, there was no precipitation observed. Without wishing to be bound by any particular theory, it is thought that the hydroxycarboxylate anion, i.e., tartrate anion, prevented the precipitation of the calcium oleate at even the lowest concentrations tested (3 g), however, it did not produce a clear solution even at the 6.0 g level.

This test was run again using a 1% sodium oleate solution, and hard water (375 ppm as CaCo3) (22 gpg). A 3.2% hydroxycarboxylate solution containing sodium tartrate, a 7.5% solution of NTA (40%), and an 8% solution of EDTA (40%) were compared. DI water was added to each solution to adjust the pH to about 11-12. The following components were added together in a beaker: 80 g of hard water; 10 g of the 1% sodium oleate solution. One of the sodium tartrate, NTA, or EDTA solutions were also added starting at 3 g. The amount of the test solutions, e.g., NTA, EDTA or sodium tartrate, added was increased in 0.5 g increments until the solution to which it was being added became clear. Deionized water was also added.

When the sodium tartrate solution was used, the solution was cloudy until shaken. After being shaken, a white precipitate was seen in the beaker. The solution quickly separated into 2 phases, a bottom clear phase, and a top portion containing the white precipitate. Up to 10 g of NTA was added, and the solution never became clear. The solution was a single phase, i.e., there were no floating precipitates. The EDTA solution became clear after adding 7 g.

The same experiment was then performed, testing additional hydroxycarboxylate formulations as well. For this second test, the amount of sodium oleate was increased until the solution became cloudy. The results are shown below in Table 2.

TABLE 2

| Amount added (g) | Amount of Sodium Oleate added to make solution cloudy (g) |
|---|---|
| 3.2% Sodium Tartrate | |
| 3 g | 1.08 g |
| 5 g | 1.39 g |
| 6 g | 1.26 g |
| 7.5% NTA | |
| 3 g | 1.48 |
| 4 g | 1.21 |
| 5 g | 1.08 |
| 8% EDTA | |
| 3 g | 1.95 g |
| 4 g | 3.07 g |
| 5 g | 9.45 g |
| 3.58% Malic acid | |
| 3 g | 0.98 g |
| 4 g | 1.33 g |
| 5 g | 2.20 g |
| 2.28% Mucic acid | |
| 3 g | 1.03 g |
| 4 g | 1.19 g |
| 5 g | 1.84 g |
| 2.96 Lactic Acid | |
| 3 g | 1.28 g |
| 4 g | 1.64 g |
| 5 g | 1.96 g |
| 3.78% Citric acid | |
| 3 g | 1.32 g |
| 4 g | 1.77 g |
| 5 g | 2.14 g |

As the compositions tested in this experiment were added to the sodium oleate solution after some of the oleate had reacted, this experiment measured the chelation ability of the tested compounds not the ability of these compounds to inhibit precipitation of calcium. The results shown in Table 2 show that, as is known in the art generally, tartaric acid is a poor chelator.

Example 2

Inhibition of Calcium Precipitation Using Hydroxycarboxylates

The ability of different acids to inhibit or prevent calcium precipitation was evaluated. The following solutions were prepared: (1) 2.4% Gantrez S95S®, commercially available from the ISP Corporation, Wayne, N.J.; (2) 2.1% tartaric acid; (3) 3% mucic acid; (4) 2.5% citric acid; (5) 2% EDTA; (6) 2% NTA; (7) 1.5% tripolyphosphate; and (8) 10.85% Alcosperse 125, commercially available from Alco Chemical, Chattanooga, Tenn. In preparing the EDTA and mucic acid solutions, 5% NaOH was added to the solutions to increase the solubility of the acids.

A 0.25% sodium oleate solution was used as the precipitating agent. The test procedure was as follows: 1 ml of the sodium oleate solution and 10 ml of one of the acid solutions described above were combined in a 400 ml beaker. DI water was added to bring the total volume up to 250 ml. To vary the pH of the solutions, 0.5% NaOH and diluted HCl were used. The solutions were titrated with $8.86\times10^{-2}$M of a $CaCl_2$ solution until the point of precipitation. The results are shown in Table 3 below:

TABLE 3

| Test Solutions | pH | Test Solutions per 10 ml (g) | $CaCl_2$ Solution (ml) | Calcium Held in Solution (g) | Calcium Held in Solution/ Test Solution | Calcium Held in Solution per 100 g | Calcium Held in Solution per 100 g (adjusted) |
|---|---|---|---|---|---|---|---|
| Tri- | 9.82 | 0.25 | 12 | 0.0425 | 0.1701 | 17.0112 | 17.0112 |
| polyphosphate | 10.75 | 0.25 | 13 | 0.0461 | 0.1843 | 18.4288 | 18.4288 |
| | 11.42 | 0.25 | 13 | 0.0461 | 0.1843 | 18.4288 | 18.4288 |
| | 12.21 | 0.25 | 12 | 0.0425 | 0.1701 | 17.0112 | 17.0112 |
| Gantrez S95S | 8.46 | 0.24 | 15 | 0.0532 | 0.2215 | 22.1500 | 22.1500 |
| | 9.89 | 0.24 | 17 | 0.0602 | 0.2510 | 25.1033 | 25.1033 |
| | 11.48 | 0.24 | 15 | 0.0532 | 0.2215 | 22.1500 | 22.1500 |
| | 12.43 | 0.24 | 21 | 0.0744 | 0.3101 | 31.0100 | 31.0100 |
| Tartaric Acid | 10.12 | 0.21 | 212 | 0.7513 | 3.5778 | 357.7752 | 2752.1172 |
| | 11.53 | 0.21 | 180 | 0.6379 | 3.0377 | 303.7714 | 2336.7033 |
| | 11.89 | 0.21 | 125 | 0.4430 | 2.1095 | 210.9524 | 1622.7106 |
| | 12.08 | 0.21 | 60 | 0.2126 | 1.0126 | 101.2571 | 778.9011 |
| | 12.3 | 0.21 | 20 | 0.0709 | 0.3375 | 33.7524 | 259.6337 |
| | 12.59 | 0.21 | 15 | 0.0532 | 0.2531 | 25.3143 | 194.7253 |
| NTA | 10.68 | 0.26 | 23 | 0.0815 | 0.3135 | 31.3508 | 31.3508 |
| | 11.31 | 0.26 | 36 | 0.1276 | 0.4907 | 49.0708 | 49.0708 |
| | 12.06 | 0.26 | 48 | 0.1701 | 0.6543 | 65.4277 | 65.4277 |
| EDTA | 9.5 | 0.2 | 90 | 0.3190 | 1.5948 | 159.4800 | 159.4800 |
| | 10.73 | 0.2 | 97 | 0.3438 | 1.7188 | 171.8840 | 171.8840 |
| | 11.26 | 0.2 | 94 | 0.3331 | 1.6657 | 166.5680 | 166.5680 |
| | 11.48 | 0.2 | 91 | 0.3225 | 1.6125 | 161.2520 | 161.2520 |
| Alcosperse | 9.8 | 0.293 | 21 | 0.0744 | 0.2540 | 25.4007 | 84.6689 |
| 125 | 10.44 | 0.293 | 22 | 0.0780 | 0.2661 | 26.6102 | 88.7008 |
| | 11.41 | 0.293 | 24 | 0.0851 | 0.2903 | 29.0294 | 96.7645 |
| | 12.21 | 0.293 | 27 | 0.0957 | 0.3266 | 32.6580 | 108.8601 |
| Mucic Acid | 9.2 | 0.3 | 13 | 0.0461 | 0.1536 | 15.3573 | 59.0667 |
| | 10.08 | 0.3 | 12 | 0.0425 | 0.1418 | 14.1760 | 54.5231 |
| | 10.82 | 0.3 | 12 | 0.0425 | 0.1418 | 14.1760 | 54.5231 |
| | 11.58 | 0.3 | 11 | 0.0390 | 0.1299 | 12.9947 | 49.9795 |
| | 12.07 | 0.3 | 13 | 0.0461 | 0.1536 | 15.3573 | 59.0667 |
| Citric Acid | 10.08 | 0.25 | 110 | 0.3898 | 1.5594 | 155.9360 | 445.5314 |
| | 11.33 | 0.25 | 90 | 0.3190 | 1.2758 | 127.5840 | 364.5257 |
| | 12.21 | 0.25 | 60 | 0.2126 | 0.8506 | 85.0560 | 243.0171 |

Figure 2:
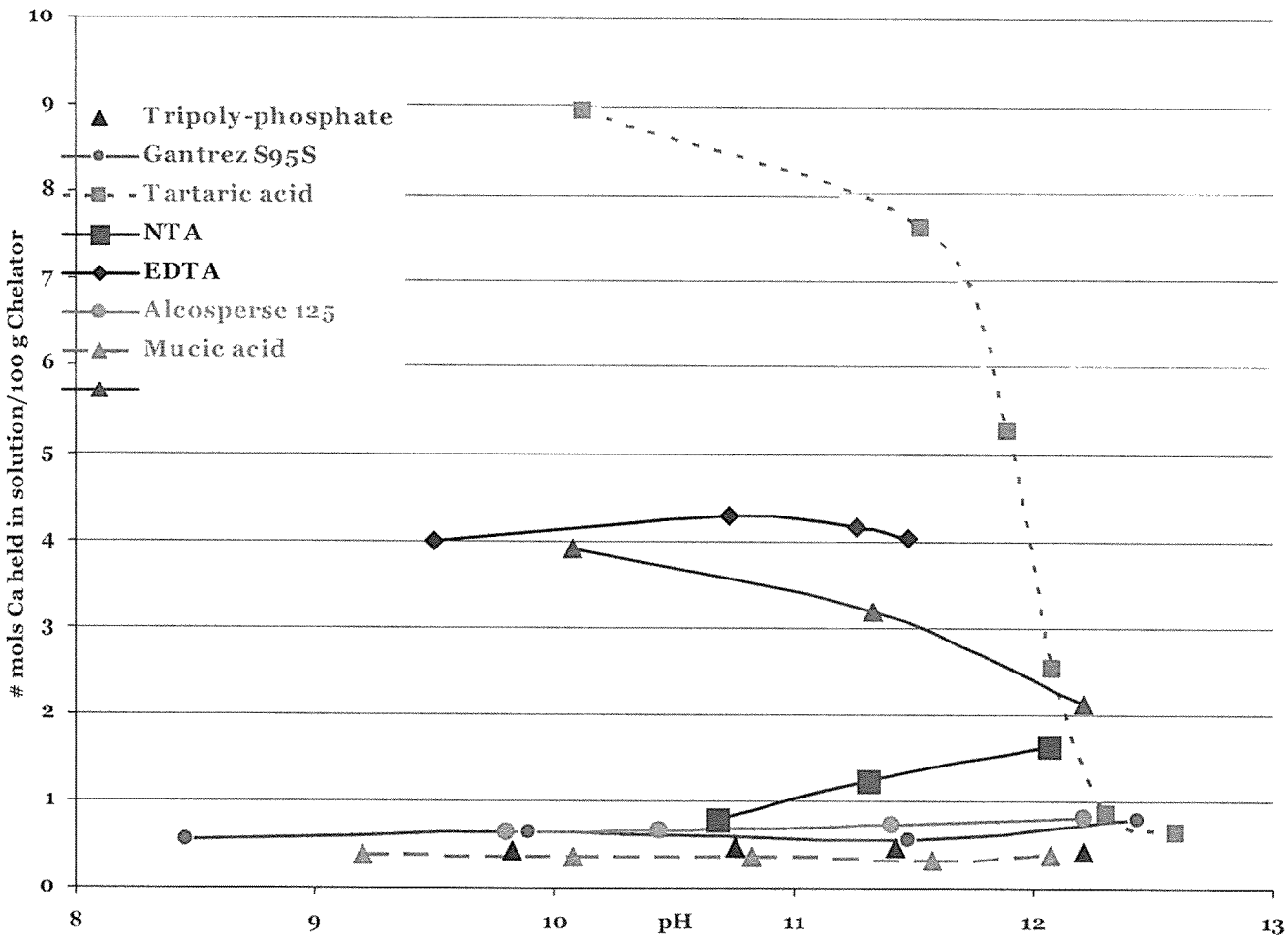
FIG. 2 is a graphical depiction of the number of moles of calcium held in solution per 100 g of test solution used as described in Example 2.

These results are also graphically depicted in FIGS. 1 and 2. FIG. 1 graphically depicts the grams of calcium held in solution per 100 g of test solution used, and FIG. 2 graphically depicts the number of moles of calcium held in solution per 100 grams of test solution used. As can be seen in these figures, the test solution containing the tartaric acid was able to hold in solution more than two times as much as all of the other solutions tested, at a pH of about 10. As the pH increased up until about 11.5, the test solution containing tartaric acid still held in solution more calcium than any of the other test solutions compared.

This test was repeated using the following compositions: 7.5% NTA sodium salt; 3.68% mucic acid; 2.45% mucic acid; 1.56% malic acid; 2.35% malic acid; 1.75% tartaric acid; and 2.63% tartaric acid. The results are shown in Table 4 below.

TABLE 4

| | Amount of CaCl2 Mix Used (grams) | | | Grams of active used | | | g of Ca/g of active on Composition | | |
|---|---|---|---|---|---|---|---|---|---|
| Composition Used | 3 g | 4 g | 5 g | 3 g | 4 g | 5 g | 3 g | 4 g | 5 g |
| 7.5% NTA sodium salt | 6.30 | 16.00 | 15.00 | 0.225 | 0.300 | 0.375 | 0.099 | 0.189 | 0.142 |
| 3.68% Mucic Acid | 3.06 | 4.47 | 5.50 | 0.110 | 0.147 | 0.184 | 0.098 | 0.108 | 0.106 |
| 2.45% Mucic Acid | 0.85 | 3.40 | 4.94 | 0.074 | 0.098 | 0.123 | 0.041 | 0.123 | 0.143 |
| 1.56% Malic Acid | 0.85 | 0.99 | 1.25 | 0.047 | 0.062 | 0.078 | 0.064 | 0.056 | 0.057 |
| 2.35% Malic Acid | 0.67 | 0.82 | 0.70 | 0.071 | 0.094 | 0.118 | 0.034 | 0.031 | 0.021 |
| 1.75% Tartaric Acid | 3.79 | 4.35 | 5.77 | 0.053 | 0.070 | 0.088 | 0.256 | 0.220 | 0.234 |
| 2.63% Tartaric Acid | 3.93 | 4.13 | 5.47 | 0.079 | 0.105 | 0.132 | 0.177 | 0.139 | 0.147 |

As can be seen from these results, tartaric acid controlled the highest amount of calcium from precipitating per gram of active material, even when the tartaric acid was highly diluted, e.g., 50-70 ppm.

Example 3

Soil Removal Test

A test was run to determine the soil removal capabilities of a cleaning composition including tartaric acid. The composition tested did not contain any builder or chelating or sequestering agents, other than the tartaric acid. A 10% solution of the following formulation was used for this study:

TABLE 5

| Ingredient | Weight Percent (wt-%) |
|---|---|
| Surfactant | about 30 |
| Sodium Polyacrylate Powder | 2.00 |
| Source of Alkalinity | about 30 |
| Additional Ingredients | about 20 |
| Tartaric Acid | 6.71 |
| Water | Balance |

The soil removal ability of the cleaning composition was tested by washing artificially soiled fabric swatches with the compositions. The soiled swatches were purchased from a manufacturer or distributor, e.g., Test Fabrics, Inc. West Pittston, Pa. The following soiled swatches were used: (a) sebum on polycotton; (b) makeup on cotton; (c) used motor oil on cotton; (d) soot/mineral oil on polycotton; (e) soot/olive oil on polycotton; (f) soot/olive oil on cotton; (g) pigment/sebum on cotton; and (h) pigment/lanolin on cotton.

To measure soil removal, the swatches were rinsed, dried, and the reflectance measured on a spectrophotometer, e.g., a HunterLab Color Quest XE system. The percent (%) soil removal (SR) was calculated from the difference between the initial (before washing) lightness (L) value and the final L value (after washing):

$$SR = \left(\frac{L_w - L_{uw}}{L_0 - L_{uw}}\right) \times 100\%$$

where:

$L_w$=lightness of the washed swatch $L_{uw}$=lightness of the soiled, unwashed swatch $L_0$=lightness of the white swatch before soiling The cleaning method performed was as follows. Thirty pounds of fill was washed for 10 minutes with no chemicals, i.e, just a water wash, on cycle 7. Backers with the swatches described above were placed in the washer. The swatches were washed with just water at cycle 13. The cleaning composition was then added, and the swatches washed. After the swatches were washed, they were removed from the washer and hung to dry.

Table 6 below shows the results of the laundry test.

TABLE 6

| Soil Type | Soil Removal (%) |
|---|---|
| Sebum on P/C | 37.20 |
| Makeup on C | 48.75 |

TABLE 6-continued

| Soil Type | Soil Removal (%) |
|---|---|
| Used Motor Oil on Cotton | 24.76 |
| Soot/Mineral Oil on P/C | 13.29 |
| Soot/Olive Oil on P/C | 29.74 |
| Soot/Olive Oil on C | 30.57 |
| Pigment/Sebum on C | 34.09 |
| Pigment/Lanolin on C | 48.30 |
| AVG | 33.34 |

As can be seen from these results, the formulation tested achieved an average of 33.34% soil removal over all fabrics and soil types. The formulation was most effective at removing makeup from cotton samples. Overall, the formulation showed effective soil removal.

Example 4

Use of Tartaric Acid and Salts Thereof as an EDTA and/or NTA Replacement in Cleaning Compositions Various cleaning compositions were tested using tartaric acid as a replacement for EDTA and/or NTA. The soil removal ability of the different cleaning compositions was tested according to the procedure described above in Example 3.

EDTA Free Cleaning Compositions

A cleaning composition including surfactant, an alkalinity source, and active enzyme composition was selected. The following formulations of the cleaning composition were prepared: Formula A included 300 ppm EDTA as a chelating agent; Formula B contained no EDTA, or other chelating agent, and 50 ppm tartaric acid; Formula C contained no EDTA, or other chelating agent, and 70 ppm tartaric acid; Formula D contained no EDTA, or other chelating agent, and 100 ppm tartaric acid; and Formula E contained no EDTA, or other chelating agent, and 200 ppm tartaric acid. All other components of the cleaning compositions were equivalent.

The following soil swatches were used: (a) make-up on cotton; (b) used motor oil on cotton; (c) soot/mineral oil on polycotton; (d) soot/mineral oil on cotton; (e) soot/olive oil on polycotton; (f) soot/olive oil on cotton; (g) pigment/sebum on cotton; (f) pigment/sebum on polycotton; and (i) pigment/lanolin on cotton. Each cleaning test was run twice for each composition, except for the cleaning composition Formula E. The average percent soil removal across both tests was computed. Table 7 shows the percent soil removed using each of the cleaning formulations.

TABLE 7

| | Soil Removal (%) | | | | |
|---|---|---|---|---|---|
| Soil Type | Formula A (300 ppm EDTA) | Formula B (50 ppm tartaric acid) | Formula C (70 ppm tartaric acid) | Formula D (100 ppm tartaric acid) | Formula E (200 ppm tartaric acid) |
| Makeup on Cotton | 18.9 | 17.80 | 20.15 | 14.08 | 18.18 |
| Used Motor Oil on Cotton | 18.90 | 20.11 | 18.58 | 15.35 | 17.18 |
| Soot/Mineral Oil on Polycotton | 14.93 | 14.44 | 14.70 | 9.54 | 11.51 |
| Soot/Mineral Oil on Cotton | 18.39 | 17.42 | 17.04 | 14.02 | 13.19 |
| Soot/Olive Oil on Polycotton | 27.40 | 23.75 | 20.83 | 19.69 | 21.35 |
| Soot/Olive Oil on Cotton | 28.70 | 27.31 | 24.96 | 23.98 | 24.82 |
| Pigment/Sebum on Cotton | 56.43 | 48.25 | 50.83 | 46.10 | 47.03 |

TABLE 7-continued

| Soil Type | Soil Removal (%) | | | | |
|---|---|---|---|---|---|
| | Formula A (300 ppm EDTA) | Formula B (50 ppm tartaric acid) | Formula C (70 ppm tartaric acid) | Formula D (100 ppm tartaric acid) | Formula E (200 ppm tartaric acid) |
| Pigment/Sebum on Polycotton | 35.76 | 21.24 | 26.06 | 16.58 | 25.65 |
| Pigment/Lanolin on Cotton | 47.37 | 41.43 | 42.10 | 39.73 | 45.91 |
| Average for all swatches | 29.64 | 25.75 | 26.14 | 22.12 | 24.98 |

Figure 3:
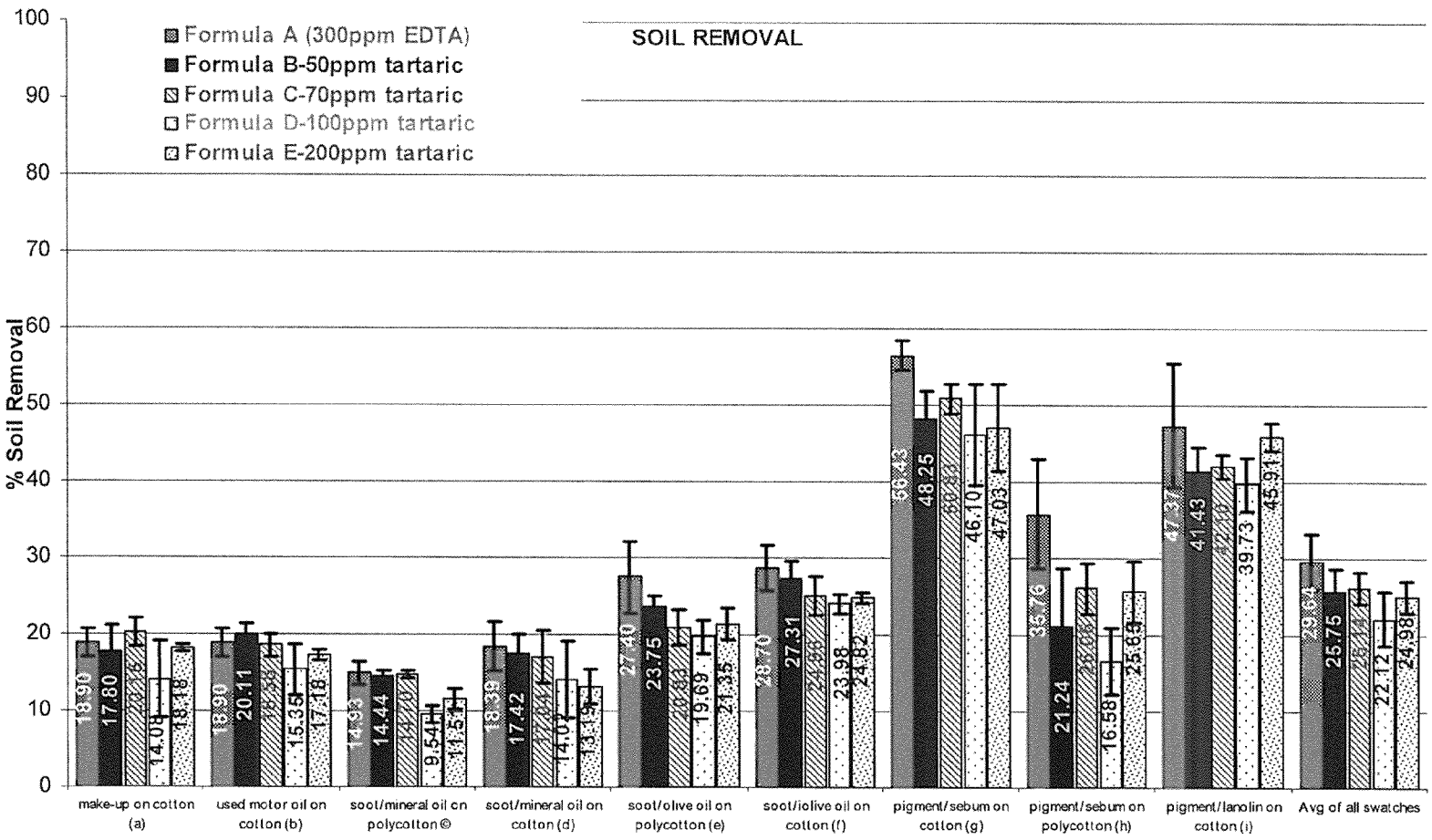
FIG. 3 is a graphical depiction of the average soil removal for five cleaning formulations as described in Example 4.

These results are also graphically depicted in FIG. 3. Overall, the average soil removal was about the same for each cleaning formulation, even though the concentration of tartaric acid in the non-EDTA formulation was substantially less than the amount of EDTA present in Formula A. The highest soil removal seen among the EDTA free formulations was with Formula C, which included 70 ppm tartaric acid. Like the EDTA formulation, the non-EDTA formulations were most effective at removing pigment/sebum from cotton.

NTA Free Cleaning Compositions

A similar test was run to compare a cleaning composition containing NTA with the same composition containing tartaric acid instead of NTA. In Formula A, the cleaning composition included 51 ppm of tartaric acid, and in Formula B, the cleaning composition included 600 ppm NTA. All of the other components of the base cleaning were equivalent between Formula A and Formula B.

To test the soil removal capabilities of the formulations, eight different soil swatches were prepared as follows: (a) sebum on polycotton; (b) make-up on cotton; (c) used motor oil on cotton; (d) soot/mineral oil on polycotton; (e) soot/olive oil on polycotton; (f) soot/olive oil on cotton; (g) pigment/sebum on cotton; and (h) pigment/lanolin on cotton.

The swatches were washed according to the procedure described above. The percent soil removal for each swatch was measured. The average soil removal across all soil samples was also measured. During the washing cycles, 51 grams of Formula A (the NTA free formulation), and 200 grams of Formula B (the formulation containing NTA) were used. Thus, the Formula B solution used was four times more concentrated than the Formula A solution used.

Table 8 below shows the average soil removal for each swatch type using Formula A and Formula B

TABLE 8

| Soil Type | Percent Soil Removal | |
|---|---|---|
| | Formula A | Formula B |
| Sebum on P/C | 4.62 | 17.90 |
| Makeup on C | 54.24 | 37.68 |

TABLE 8-continued

| Soil Type | Percent Soil Removal | |
|---|---|---|
| | Formula A | Formula B |
| Dirty Motor Oil on P/C | 27.85 | 17.96 |
| Soot/Mineral Oil on P/C | 15.28 | 9.56 |
| Soot/Olive Oil on P/C | 23.98 | 28.96 |
| Soot/Olive Oil on C | 32.43 | 26.82 |
| Sebum on C | 58.68 | 52.89 |
| Lanolin on C | 54.28 | 44.51 |
| AVG | 33.92 | 29.54 |

Figure 4:
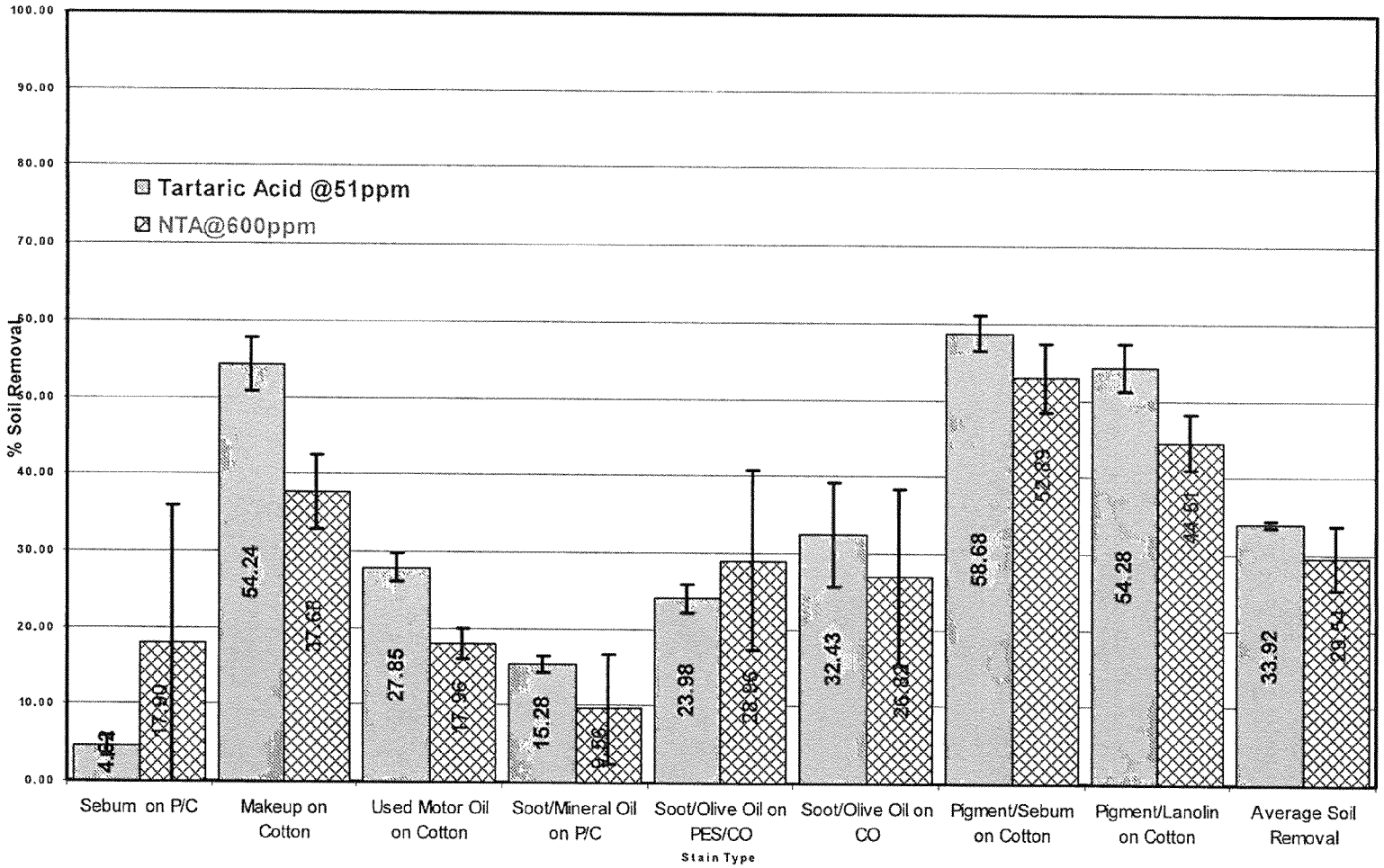
FIG. 4 is a graphical depiction of the average soil removal for two cleaning formulations as described in Example 4.
Figure 5A:
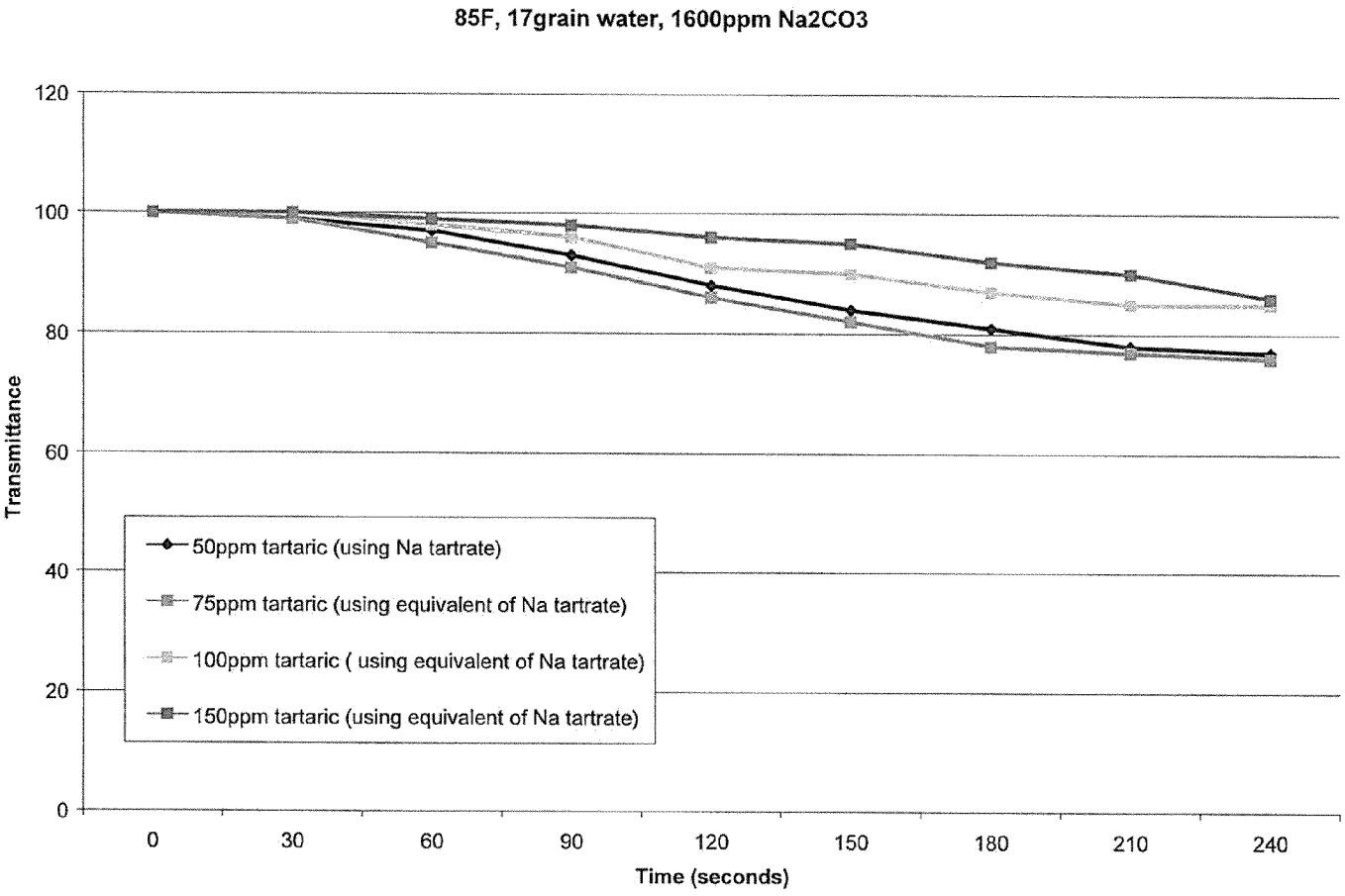
FIG. 5A is a graphical depiction of the percent transmission over time at 85° F. for four different test solutions of the present invention as described in Example 7.
Figure 5B:
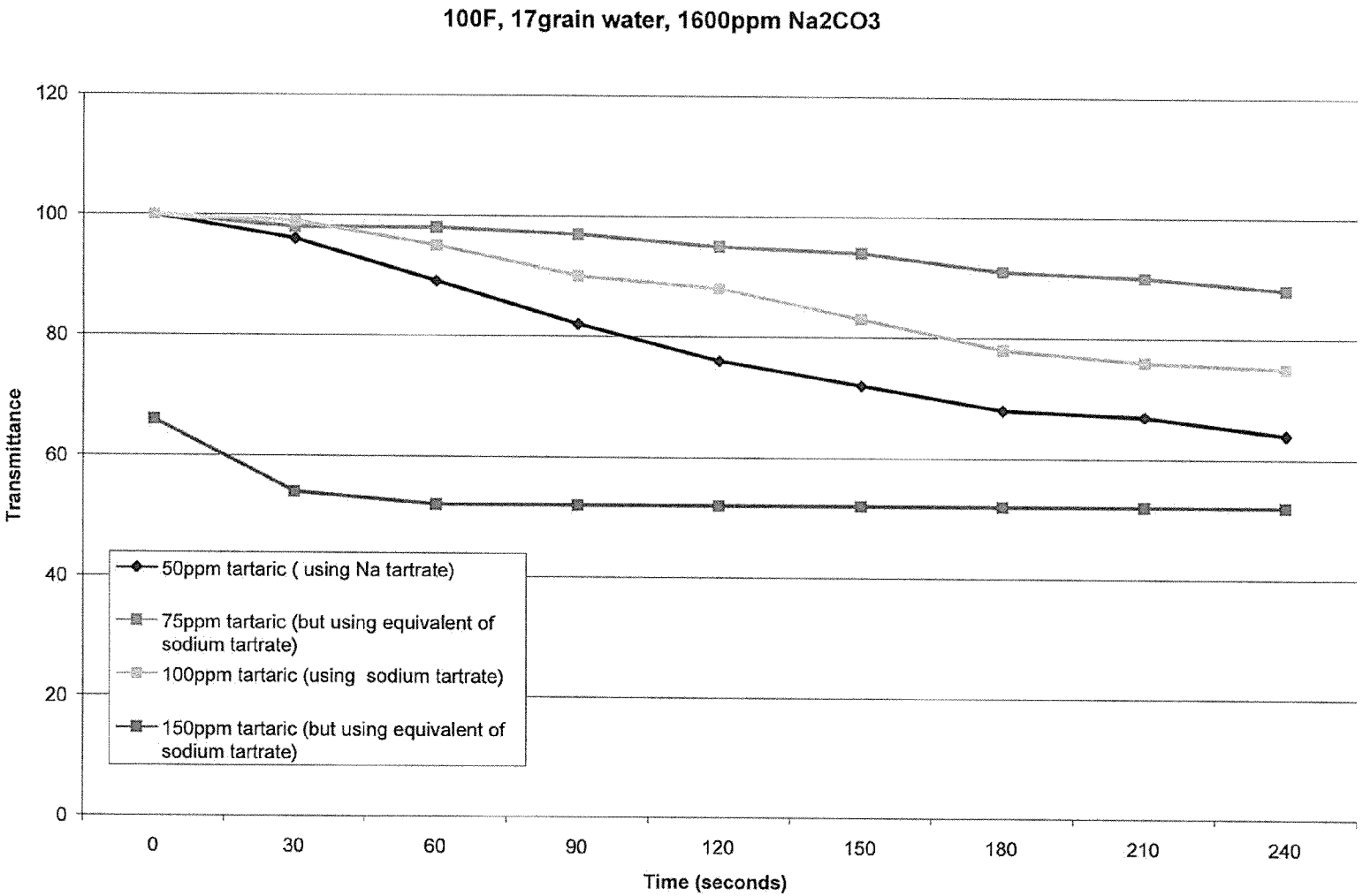
FIG. 5B is a graphical depiction of the percent transmission over time at 100° F. for four different test solutions of the present invention as described in Example 7.
Figure 5C:
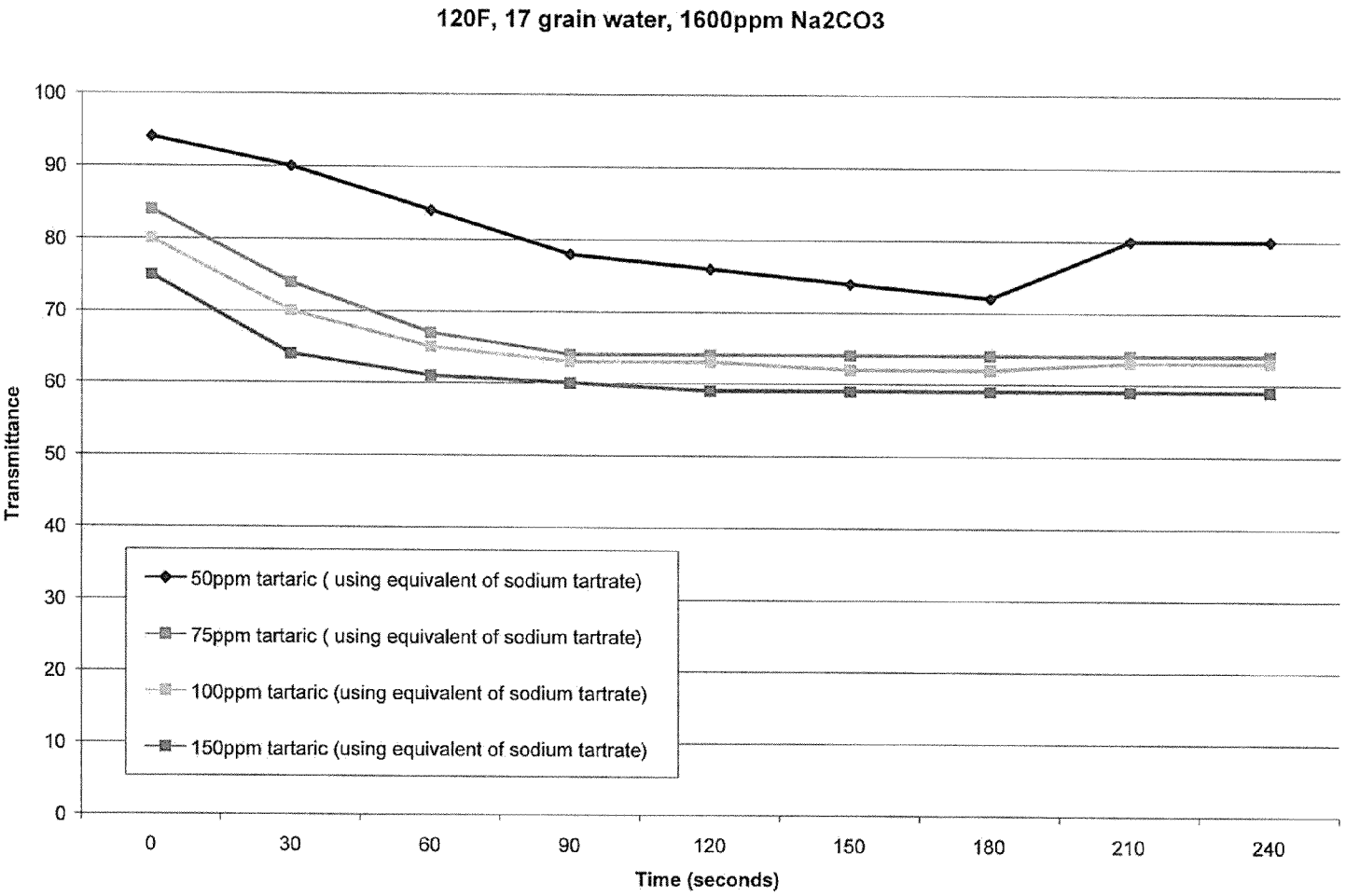
FIG. 5C is a graphical depiction of the percent transmission over time at 120° F. for four different test solutions of the present invention as described in Example 7.
Figure 5D:
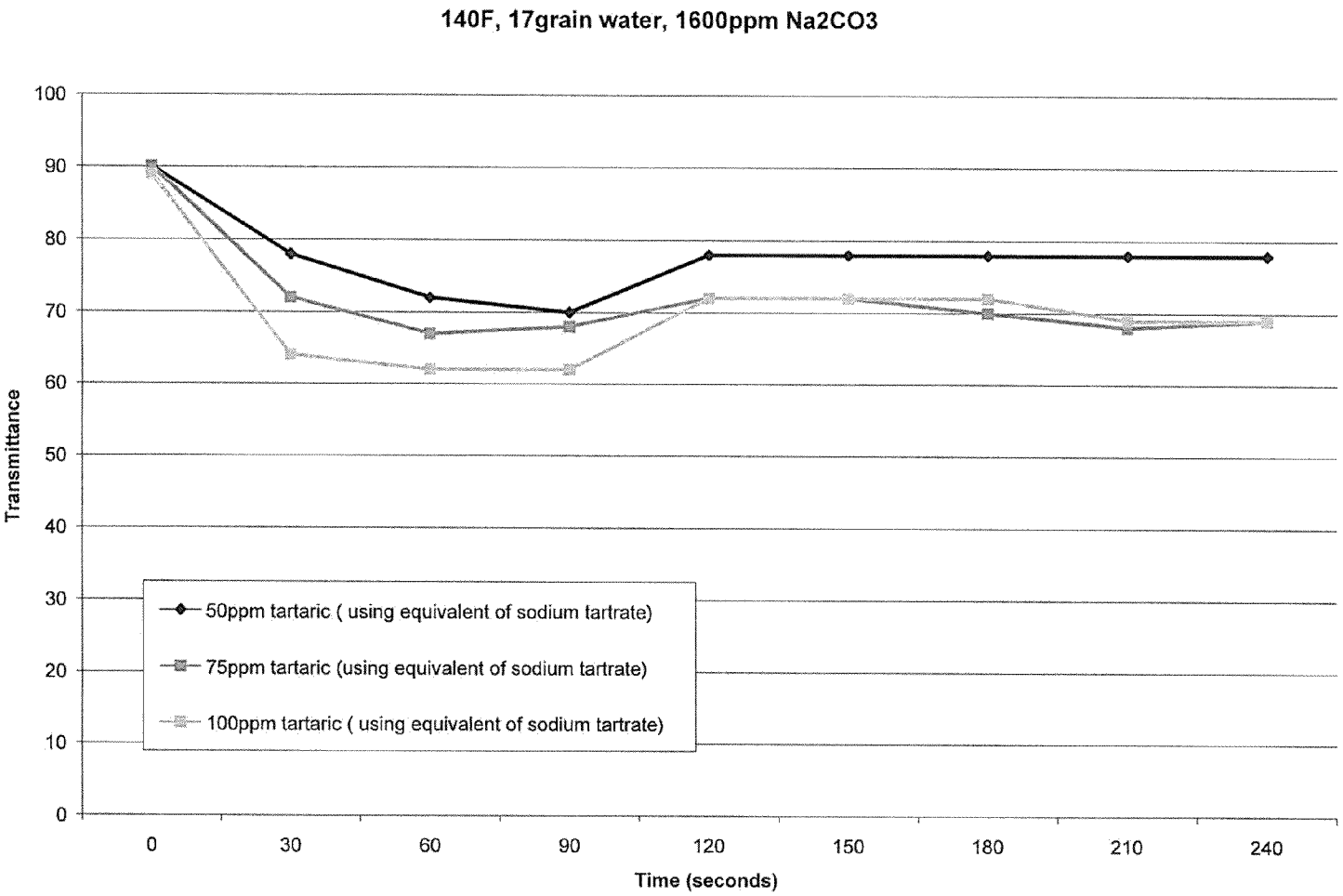
FIG. 5D is a graphical depiction of the percent transmission over time at 140° F. for four different test solutions of the present invention as described in Example 7.

These results are also graphically depicted in FIG. 4. As can be seen in FIG. 4, overall, the average soil removal was higher for the swatches cleaned using the less concentrated Formula A with tartaric acid. Although the difference in the average percent soil removal was relatively small, it should be noted that the concentration of Formula A used was four times less than the concentration of Formula B used. Further, only 51 ppm tartaric acid was needed to achieve these results, while over ten times as much NTA was needed. Overall, the formulation containing tartaric acid as an NTA replacement achieved equal if not greater soil removal than the formulation with NTA, even at a much lower use concentration.

Example 4

Water Conditioning Tests

A water conditioning test was performed to evaluate the ability of a solution containing tartaric acid to inhibit calcium precipitation in an aqueous system. 0.1% solutions of the formulations shown in Table 9 below were used. The pH of each of the 0.1% solutions was adjusted with KOH (45%) to approximately 10.2.

TABLE 9

| Raw Material | Formula with EDTA | Formula with Sodium Tartrate | Formula with Gantrez S-95 | Formula with no polymer and no water conditioner | Formula with sodium polyacrylate powder and no polymer |
|---|---|---|---|---|---|
| Surfactant (wt-%) | about 30 | about 30 | about 30 | about 30 | about 30 |
| Tetrasodium EDTA (wt-%) | 17.00 | 0 | 0 | 0 | 0 |
| Source of alkalinity (wt-%) | about 30 | about 30 | about 30 | about 30 | about 30 |
| Additional ingredients (wt-%) | about 20 | about 20 | about 20 | about 20 | about 20 |
| Sodium Tartrate (wt-%) | 0 | 3.00 | 0 | 0 | 0 |
| Gantrez S-95 (wt-%) | 0 | 0 | 2.60 | 0 | 0 |

TABLE 9-continued

| Raw Material | Formula with EDTA | Formula with Sodium Tartrate | Formula with Gantrez S-95 | Formula with no polymer and no water conditioner | Formula with sodium polyacrylate powder and no polymer |
|---|---|---|---|---|---|
| Sodium polyacrylate powder (wt-%) | 0 | 0 | 0 | 0 | 2.00 |
| KOH (45%) (wt-%) | 0 | 0 | 3.90 | 0 | 0 |
| Water | Balance | Balance | Balance | Balance | Balance |

The turbidity of each formulation was tested at varying water hardnesses (10, 12, 14, 16, 18, and 20 grain water) and at 85° F., 140° F., 160° F. The following test was used to measure turbidity of the formulations. 1000 ml of DI water and a stir bar were added to four 1500 ml beakers. The beakers were then placed on a stirrer/hot plate, and heating is initiated. 5 ml of a sodium bicarbonate solution was added to each beaker. When the water temperature reaches 85° F., a hardness solution (1 ml equals 2 grains of hardness) was added to each beaker. 4.0 ml were added to each beaker. After the sample was completely mixed, the stirrer was turned off. When the temperature reached 85° F., an initial reading was taken. Readings of the transmittance of the solutions at 560 nm were then taken at 140° F., and 160° F.

The results are shown as percent transmittance in Table 10 below.

TABLE 10

| | Temp. | Water Hardness (grain) | | | | | |
|---|---|---|---|---|---|---|---|
| | (° F.) | 10 | 12 | 14 | 16 | 18 | 20 |
| Formula with Sodium Tartrate | | | | | | | |
| % Transmittance | 85 | 89.8 | 35.4 | 33.8 | | | |
| | 140 | 50.6 | 22.8 | 21.2 | | | |
| | 160 | 41.0 | 16.6 | 21.2 | | | |
| Formula with EDTA (no polymer) | | | | | | | |
| % Transmittance | 85 | 96.8 | 92.0 | 89.2 | 87.6 | 73.4 | 70.4 |
| | 140 | 84.0 | 63.6 | 56.8 | 54.8 | 50.0 | 44.8 |
| | 160 | 61.4 | 53.8 | 55.8 | 47.8 | 45.8 | 41.2 |
| Formula with Gantrez S-95 | | | | | | | |
| % Transmittance | 85 | 99.8 | | | | | 99.4 |
| | 140 | 96.8 | | | | | 93.2 |
| | 160 | 68.4 | | | | | 64.2 |
| Formula with sodium polyacrylate powder and no water conditioner | | | | | | | |
| % Transmittance | 85 | 97.8 | | | | | 97.4 |
| | 140 | 96.6 | | | | | 81.4 |
| | 160 | 61.4 | | | | | 58.6 |
| Formula with no polymer and no water conditioner | | | | | | | |
| % Transmittance | 85 | 97.8 | | | | | |
| | 140 | 64.8 | | | | | |
| | 160 | 61.8 | | | | | |

Example 5

Effect of the Addition of an Acid to a Composition Including Tartaric Acid on the Ability of the Composition to Inhibit Calcium Precipitation Another test was run to determine the effect of a combination of acids on the precipitation of calcium. The following four solutions were tested: (1) 16 grain water, and 10 ml Formula A, i.e., 330 ppm sodium hydroxide, and 300 ppm sodium carbonate; (2) 20 grain hard water, and 10 ml Formula A; (3) 16 grain water and 10 ml Formula B, i.e., 479 ppm sodium hydroxide, and 107 ppm sodium sulfate; and (4) 20 grain water and 10 ml Formula B. Each of the above four solutions also contained 100 ppm tartaric acid and 50 ppm of an additional acid, GL-38-5, commercially available from Akzo Nobel, Chicago, Ill. The results are shown below.

TABLE 11

| | | Test 1 | Test 2 | Test 3 | Test 4 |
|---|---|---|---|---|---|
| % Transmittance | 85° F. | 100 | 98 | 99 | 97 |
| | 140° F. | 84 | 81 | 81 | 79 |
| | 160° F. | 81.5 | 83 | 78.9 | 76 |

As can be seen in this table, at 85° F. all four test solutions were able to substantially inhibit calcium precipitation.

The effect of tartaric acid in combination with sodium citrate to prevent or inhibit calcium precipitation was also tested. The following four solutions were tested: (5) 16 grain water, and 10 ml Formula A; (6) 20 grain hard water, and 10 ml Formula A; (7) 16 grain water and 10 ml Formula B; and (8) 20 grain water and 10 ml Formula B. Each of the four solutions also contained 50 ppm tartaric acid and 50 ppm of sodium citrate. The results are shown below.

TABLE 12

| | | Test 5 | Test 6 | Test 7 | Test 8 |
|---|---|---|---|---|---|
| % Transmittance | 85° F. | 98 | 97.5 | 96.5 | 96.5 |
| | 140° F. | 87.2 | 76 | 70 | 66 |
| | 160° F. | 86.5 | 76 | 69.8 | 66 |

As can be seen from this table, the combination of tartaric acid and sodium citrate prevented calcium precipitation best in Test 5 (16 grain water, and 10 ml of Formula A).

The effect of increasing the amount of tartaric acid used, with varying water hardness, on the precipitation of calcium was also measured. The following four solutions were tested: (9) 400 ppm tartaric acid and 10 ml Formula A with 16 grain water; (10) 400 ppm tartaric acid and 10 ml Formula A with 20 grain water; (11) 400 ppm tartaric acid, and 10 ml Formula B with 16 grain water; and (12) 400 ppm tartaric acid, and 10 ml Formula B with 20 grain water. The results are shown in the table below.

TABLE 13

| | | Test 9 (16 grain water) | Test 10 (20 grain water) | Test 11 (16 grain water) | Test 12 (20 grain water) |
|---|---|---|---|---|---|
| % Transmittance | 85° F. | 100 | 99.5 | 100 | 99 |
| | 140° F. | 71.2 | 69 | 79 | 63 |
| | 160° F. | 69.2 | 66 | 81 | 61.9 |

Although very good results were seen across all samples at 85° F., at 140° F. the results seen with 400 ppm tartaric acid were not as good as those seen previously with 100 ppm tartaric acid at this temperature. Thus, at increased temperatures, increasing the amount of tartaric acid added did not increase the inhibition of calcium precipitation.

Example 6

Inhibition of Calcium Precipitation Using a Cleaning Composition Including Tartaric Acid The effect of adding tartaric acid to known cleaning compositions on calcium precipitation was evaluated. The alkalinity sources from commercially available compositions, at use concentrations, were used for these tests. Formula A contained 330 ppm NaOH and 300 ppm sodium carbonate. Formula B contained 479 ppm NAOH and 107 ppm sodium sulfate. The following test solutions using either Formula A or Formula B as a base composition were prepared: (1) 100 ppm tartaric acid, and 10 ml Formula A at 16 grain water hardness; (2) 100 ppm tartaric acid, and 10 ml Formula A at 20 grain water hardness; (3) 100 ppm tartaric acid, and 10 ml Formula A at 24 grain water hardness; (4) 100 ppm tartaric acid, and 10 ml Formula A at 30 grain water hardness; (5) 100 ppm tartaric acid, and 10 ml Formula B at 16 grain water hardness; (6) 100 ppm tartaric acid, and 10 ml Formula B at 20 grain water hardness; (7) 100 ppm tartaric acid, and 10 ml Formula B at 24 grain water hardness; (8) 100 ppm tartaric acid, and 10 ml Formula B at 30 grain water hardness. Measurements of the turbidity (reported as percent transmittance) were taken at three different temperatures: 85° F., 140° F., and 160° F.

The results are shown below

TABLE 14

| | | Test Number | | | | | | | |
|---|---|---|---|---|---|---|---|---|---|
| | | 1 | 2 | 3 | 4 | 5 | 6 | 7 | 8 |
| Water Hardness (grains per gallon) | | 16 | 20 | 24 | 30 | 16 | 20 | 24 | 30 |
| % Transmittance | 85° F. | 98.5 | 97.9 | 97.5 | 87 | 98.5 | 83.5 | 73 | 80 |
| | 140° F. | 84.5 | 74.1 | 77.1 | 58 | 84 | 65.2 | 59.1 | 56.5 |
| | 160° F. | 84.5 | 74.1 | 77.1 | 58 | 84 | 65.2 | 57.9 | 56.5 |

As can be seen from Table 14, as the water hardness was increased for both sets of test solutions, i.e., those using Formula A (tests 1-4) and those using Formula B (5-8) the percent transmittance decreased. That is the ability of the test solutions to inhibit or prevent calcium precipitation decreased as the water hardness increased. Similarly, as the temperature increased, the ability of the test solutions to inhibit calcium precipitation also decreased.

Another test was run with 400 ppm tartaric acid and the same base cleaning compositions, i.e., Formulas A and B, with 16 grain and 20 grain water. The solutions were as follows: (9) 400 ppm tartaric acid and 10 ml Formula A with 16 grain water hardness; (10) 400 ppm tartaric acid with 10 ml Formula A with 20 grain water hardness; (11) 400 ppm tartaric acid and 10 ml Formula B with 16 grain water hardness; and (12) 400 ppm tartaric acid and 10 ml Formula B with 20 grain water hardness. The turbidity of these solutions was measured at varying temperatures. The results are shown as percent transmittance in the table below.

TABLE 15

| | | 9 | 10 | 11 | 12 |
|---|---|---|---|---|---|
| Water Hardness (Grains per Gallon) | | 16 | 20 | 16 | 20 |
| % Transmittance | 85° F. | 100 | 99.5 | 100 | 99 |
| | 140° F. | 71.2 | 69 | 79 | 63 |
| | 160° F. | 69.2 | 66 | 81 | 61.9 |

Another test was run with varying amounts of tartaric acid, either 10 ml of Formula A or 10 ml of Formula B, and 16 grain water hardness. The turbidity was measured. The results are shown in the table below.

TABLE 16

| | Transmittance (%) | | |
|---|---|---|---|
| Tartaric Acid (ppm) | 85° F. | 140° F. | 160° F. |
| 10 ml Formula A-16 grain water | | | |
| 25 | 98.1 | 80 | 80.5 |
| 40 | 97.5 | 84.1 | 84 |
| 50 | 98.5 | 88 | 89 |
| 60 | 97.9 | 84.5 | 84.5 |
| 75 | 98.9 | 88 | 87.8 |
| 200 | 100 | 83.5 | 84 |
| 10 ml Formula B-16 grain water | | | |
| 25 | 97 | 82.1 | 81.9 |
| 40 | 97.1 | 85 | 82.5 |
| 50 | 98 | 90.5 | 90.5 |
| 60 | 98 | 83 | 83 |

TABLE 16-continued

| | Transmittance (%) | | |
|---|---|---|---|
| Tartaric Acid (ppm) | 85° F. | 140° F. | 160° F. |
| 75 | 98 | 90 | 87.9 |
| 200 | 99.5 | 78.5 | 78.5 |

Overall, it was shown that at higher temperatures the inhibition of calcium precipitation was maximized when the tartaric acid was present at 50 and 75 ppm.

The tests were repeated using 25, 40, 50, 60, and 75 ppm tartaric acid in various formulations with a 16 grain water hardness. The turbidity of each of these formulations was measured. The results are shown below.

TABLE 17

| | Transmittance (%) | | |
|---|---|---|---|
| Tartaric Acid (ppm) | 85° F. | 140° F. | 160° F. |
| 10 ml Formula A-16 grain water | | | |
| 25 | 97.5 | 81.1 | 80.1 |
| 40 | 96.9 | 88 | 84 |

TABLE 17-continued

| Tartaric Acid (ppm) | Transmittance (%) 85° F. | 140° F. | 160° F. |
|---|---|---|---|
| 50 | 98.5 | 87.1 | 88 |
| 60 | 97.9 | 78.1 | 77.5 |
| 75 | 98.9 | 82 | 81.5 |
| 10 ml Formula B-16 grain water | | | |
| 25 | 97 | 87.2 | 84.5 |
| 40 | 97.5 | 83.2 | 83 |
| 50 | 97.9 | 84 | 82.1 |
| 60 | 98.5 | 82.1 | 77.8 |
| 75 | 98.5 | 85.5 | 85 |

As can be seen from these results, at elevated temperatures, i.e., 140° F. and 160° F., the compositions including 50 ppm and 75 ppm tartaric acid most effectively inhibited the precipitation of calcium in the solutions.

Example 7

Ability of Varying Compositions to Inhibit Calcium Precipitation Over Time

Beaker tests using 17 grain water at varying temperatures were run to determine the ability of cleaning compositions including varying levels of tartaric acid, or a sodium salt thereof, to inhibit calcium precipitation over time. The cleaning compositions tested included 1600 ppm $Na_2CO_3$, and varying levels of tartaric acid, i.e., 50, 75, 100, or 150 ppm. The turbidity of the solutions was tested at 85° F., 100° F., 120° F., 140° F., and 160° F. The percent transmittance over time (seconds) was measured for each test solution. The results are shown in the table below.

TABLE 18

| | | | | | | | | | |
|---|---|---|---|---|---|---|---|---|---|
| 85° F. | | | | | | | | | |
| 50 ppm Sodium Tartrate | | | | | | | | | |
| Transmittance | 100 | 99 | 97 | 93 | 88 | 84 | 81 | 78 | 77 |
| Time (sec) | 0 | 30 | 60 | 90 | 120 | 150 | 180 | 210 | 240 |
| 75 ppm Sodium Tartrate | | | | | | | | | |
| Transmittance | 100 | 99 | 95 | 91 | 86 | 82 | 78 | 77 | 76 |
| Time (sec) | 0 | 30 | 60 | 90 | 120 | 150 | 180 | 210 | 240 |
| 100 ppm Sodium Tartrate | | | | | | | | | |
| Transmittance | 100 | 100 | 98 | 96 | 91 | 90 | 87 | 85 | 85 |
| Time (sec) | 0 | 30 | 60 | 90 | 120 | 150 | 180 | 210 | 240 |
| 150 ppm Sodium Tartrate | | | | | | | | | |
| Transmittance | 100 | 100 | 99 | 98 | 96 | 95 | 92 | 90 | 86 |
| Time (sec) | 0 | 30 | 60 | 90 | 120 | 150 | 180 | 210 | 240 |
| 100° F. | | | | | | | | | |
| 50 ppm Sodium Tartrate | | | | | | | | | |
| Transmittance | 100 | 96 | 89 | 82 | 76 | 72 | 68 | 67 | 64 |
| Time (sec) | 0 | 30 | 60 | 90 | 120 | 150 | 180 | 210 | 240 |
| 75 ppm Sodium Tartrate | | | | | | | | | |
| Transmittance | 100 | 98 | 98 | 97 | 95 | 94 | 91 | 90 | 88 |
| Time (sec) | 0 | 30 | 60 | 90 | 120 | 150 | 180 | 210 | 240 |
| 100 ppm Sodium Tartrate | | | | | | | | | |
| Transmittance | 100 | 99 | 95 | 90 | 88 | 83 | 78 | 76 | 75 |
| Time (sec) | 0 | 30 | 60 | 90 | 120 | 150 | 180 | 210 | 240 |
| 150 ppm Sodium Tartrate | | | | | | | | | |
| Transmittance | 66 | 54 | 52 | 52 | 52 | 52 | 52 | 52 | 52 |
| Time (sec) | 0 | 30 | 60 | 90 | 120 | 150 | 180 | 210 | 240 |
| 120° F. | | | | | | | | | |
| 50 ppm Sodium Tartrate | | | | | | | | | |
| Transmittance | 94 | 90 | 84 | 78 | 76 | 74 | 72 | 80 | 80 |
| Time (sec) | 0 | 30 | 60 | 90 | 120 | 150 | 180 | 210 | 240 |
| 75 ppm Sodium Tartrate | | | | | | | | | |
| Transmittance | 84 | 74 | 67 | 64 | 64 | 64 | 64 | 64 | 64 |
| Time (sec) | 0 | 30 | 60 | 90 | 120 | 150 | 180 | 210 | 240 |
| 100 ppm Sodium Tartrate | | | | | | | | | |
| Transmittance | 80 | 70 | 65 | 63 | 63 | 62 | 62 | 63 | 63 |
| Time (sec) | 0 | 30 | 60 | 90 | 120 | 150 | 180 | 210 | 240 |
| 150 ppm Sodium Tartrate | | | | | | | | | |
| Transmittance | 75 | 64 | 61 | 60 | 59 | 59 | 59 | 59 | 59 |
| Time (sec) | 0 | 30 | 60 | 90 | 120 | 150 | 180 | 210 | 240 |
| 140° F. | | | | | | | | | |

TABLE 18-continued

| | | | | | | | | | |
|---|---|---|---|---|---|---|---|---|---|
| | 50 ppm Sodium Tartrate | | | | | | | | |
| Transmittance | 90 | 78 | 72 | 70 | 78 | 78 | 78 | 78 | 78 |
| Time (sec) | 0 | 30 | 60 | 90 | 120 | 150 | 180 | 210 | 240 |
| | 75 ppm Sodium Tartrate | | | | | | | | |
| Transmittance | 90 | 72 | 67 | 68 | 72 | 72 | 70 | 68 | 69 |
| Time (sec) | 0 | 30 | 60 | 90 | 120 | 150 | 180 | 210 | 240 |
| | 100 ppm Sodium Tartrate | | | | | | | | |
| Transmittance | 89 | 64 | 62 | 62 | 72 | 72 | 72 | 69 | 69 |
| Time (sec) | 0 | 30 | 60 | 90 | 120 | 150 | 180 | 210 | 240 |

The results from this study are also graphically depicted in FIGS. 5A-5D. It should be noted that 150 ppm sodium tartrate at 140° F., and 50, 75, 100, and 150 ppm sodium tartrate at 160° F. could not be measured. It was theorized that as the water heated up it released $CO_2$ and alkalinized by itself therefore precipitating $CaCO_3$. As can be seen from these results, at elevated temperatures, i.e., 120° F., and 140° F., the compositions including lower amounts of sodium tartrate, i.e., 50 and 75 ppm, inhibited the precipitation of calcium better than those solution including higher levels of sodium tartrate.

Without wishing to be bound by any particular theory it was theorized that an increase was seen in the transmittance between about 90 seconds and about 180 seconds at 140° F., because as time passed the precipitate flocked out resulting in a clear solution and large precipitate.

Example 8

Evaluation of the Cleaning Ability of Various Vehicle Cleaners to Remove Soils The purpose of this test was to determine the relative touchless cleaning ability of compositions of the present invention, and other various vehicle cleaners to remove tough clay soils. The black panels used in the test were soiled with road side dirt which was baked onto the panels multiple times. The final rinsed and dried panels had a visible film on the surface which was easily removed by friction but very difficult to remove by chemical action/water rinsing only. Black panels were determined to provide the highest visible contrast between a dirty, filmed surface and a clean surface.

Standard soils were obtained from the dirt/mud from the area of interest. Soil was taken from areas near high traffic preferably at corners of intersections where vehicle stops/starts are common. The control Northern California soil is found during winter months (January-March) in Sacramento, Calif. area (high in iron silicate). If a soil was to be engineered it would consist of clay (such as bentonite), motor oil, brake dust, organic matter and/or fine sand/silica.

Four formulas were tested. Each formula had the same ingredients found in conventional car wash compositions. Formula A also included 3 wt-% tetrasodium EDTA (40%), and 3 wt-% trisodium HEDTA liquid (38%). Formula B had the same base formula ingredients as Formula A, however the EDTA and HEDTA were replaced with 6.16 wt-% of a commercially available chelating agent, Dissolvine GL-38s (38%). Formula C had the same base formula ingredients as Formula A, however, the EDTA and HEDTA were replaced with 6.32 wt-% of a commercially available chelating agent, Octaquest E30 (37%) active. Formula D had the same base formula ingredients as Formula A, however the EDTA and HEDTA were replaced with 2.34 wt-% of a hydroxycarboxylate threshold agent, i.e., sodium tartrate (99%), in accordance with the present invention.

For the test, a 200 ml sample of a standard drying agent was made up using 2 ml of the drying agent at 100:1 dilution. A pan is filled with the drying agent. Clean and dry panels are rinsed in drying agent and then rinsed with soft water. The drying agent will help soil coat more uniformly on panel surface.

The pan was then rinsed out and filled with 200 ml water and 100-150 g soil forming a thin, mud-like solution. Each test panel was then placed into the pan and the pan was shaken until the panel can be lifted out while maintaining a uniform coating of mud across its surface. The surface of the panel was not be touched during this process.

Once coated, the panel was placed into an oven set at 80° C. and dried for approximately 10 minutes. The coating process was then repeated twice more without a water rinse resulting in three complete coatings. The final coated panel was then thoroughly rinsed with soft water and then dried. The panels were stored so that nothing touches the surface. 11 different soil samples were tested.

To evaluate the soil removal abilities of the four formulas, a single drop of each cleaning formula was placed on a panel. After waiting an appropriate amount of time to permit cleaning action, the panels were thoroughly rinsing with soft water and then drying. Each test formulation was rinsed off of the test coupon 1 minute after deposition. For this experiment, each of the above formulations was tested at a 250:1 dilution ratio.

The results were based solely on visual analyses using a scale of 1 (no soil removal) to 5 (complete soil removal). Table 19 shows the results from this test.

TABLE 19

| SOIL REMOVAL | | | | |
|---|---|---|---|---|
| | Formula | | | |
| Soil Sample | A | B | C | D |
| 1 | 4 | 1 | 1 | 2 |
| 2 | 4 | 3 | 3 | 4 |
| 3 | 4 | 2 | 2 | 4 |
| 4 | 4 | 2 | 2 | 4 |
| 5 | 4 | 3 | 3 | 4 |
| 6 | 4 | 4 | 3 | 4 |
| 6 | 4 | 3 | 3 | 3 |
| 7 | 4 | 3 | 3 | 3 |
| 8 | 3 | 2 | 1 | 3 |
| 9 | 4 | 4 | 3 | 4 |
| 10 | 4 | 2 | 3 | 3 |
| AVG | 3.9 | 2.6 | 2.5 | 3.5 |

As can be seen from these results, the formula using sodium tartrate (Formula D) according to the present invention maintained similar soil removal performance compared to the formula including EDTA and HEDTA (Formula A). The use of biodegradable chelating agents in Formulas B and C performed significantly inferior to the EDTA/HEDTA and tartrate formulations.

We claim:

1. A cleaning composition comprising:

(a) about 0.004 wt-% to about 0.008 wt-% of a hydroxycarboxylate; and (b) about 0 wt % to about 50 wt-% source of alkalinity selected from an alkali metal hydroxide and mixtures thereof, and (c) a cleaning agent comprising a surfactant, wherein the composition is substantially free of builder, chelating agent or sequestrant.

2. The cleaning composition of claim 1, wherein the cleaning composition is substantially free of a compound selected from the group consisting of phosphates, polyphosphates, phosphonates, aminocarboxylates, and mixtures thereof.

3. The cleaning composition of claim 1, wherein the hydroxycarboxylate compound is selected from the group consisting of tartaric acid and salts thereof.

4. The cleaning composition of claim 1, wherein the alkali metal hydroxide is selected from the group consisting of sodium hydroxide, lithium hydroxide, potassium hydroxide, and combinations thereof.

5. The composition of claim 1, wherein the composition has at least a 95% transmittance of light at 85° F.

6. The composition of claim 1, wherein the composition has at least a 95% transmittance of light at 100° F.

7. The composition of claim 1, wherein the composition has at least an 80% transmittance of light at 120° F.

8. The composition of claim 1, wherein the composition has at least an 85% transmittance of light at 140° F.

* * * * *